US010201046B2

(12) United States Patent
Hasegawa et al.

(10) Patent No.: US 10,201,046 B2
(45) Date of Patent: Feb. 5, 2019

(54) ILLUMINATION APPARATUS AND LIGHTING DEVICE USED THEREBY

(71) Applicant: Panasonic Corporation, Osaka (JP)

(72) Inventors: Junichi Hasegawa, Osaka (JP); Hiroshi Kido, Osaka (JP); Akinori Hiramatsu, Nara (JP); Shigeru Ido, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 443 days.

(21) Appl. No.: 14/337,447

(22) Filed: Jul. 22, 2014

(65) Prior Publication Data

US 2015/0035441 A1 Feb. 5, 2015

(30) Foreign Application Priority Data

Aug. 2, 2013 (JP) ..... 2013-161484

(51) Int. Cl.
*H05B 33/08* (2006.01)

(52) U.S. Cl.
CPC ..... *H05B 33/0815* (2013.01); *H05B 33/0827* (2013.01); *H05B 33/0857* (2013.01)

(58) Field of Classification Search
CPC .. H05B 35/00; H05B 37/029; H05B 33/0815; F21Y 2113/00
USPC ..... 315/178, 291 M, 324 M; 362/212; 307/157
See application file for complete search history.

(56) References Cited

U.S. PATENT DOCUMENTS

2006/0109389 A1* 5/2006 Ichikawa ..... G09G 3/342 349/1
2006/0125320 A1 6/2006 Namba et al.
2009/0200963 A1* 8/2009 Kitagawa ..... H05B 33/089 315/297
2010/0045195 A1* 2/2010 Yamamuro ..... H02M 3/33507 315/219

(Continued)

FOREIGN PATENT DOCUMENTS

JP 2006-019097 A 1/2006
JP 2006-147355 A 6/2006

(Continued)

OTHER PUBLICATIONS

Chinese Office Action dated Mar. 9, 2016 for corresponding Chinese Application No. 201410377467.8 and partial English translation.

*Primary Examiner* — Douglas W Owens
*Assistant Examiner* — Syed M Kaiser
(74) *Attorney, Agent, or Firm* — Renner Otto Boisselle & Sklar, LLP

(57) ABSTRACT

An illumination apparatus includes light sources differing from one another in terms of light-emission color and voltage drop when identical current flows therein, switches in one-to-one correspondence with the light sources, a DC power supply circuit, and a control circuit. The control circuit performs a first control of the switches through a time division control method such that an on-period of each switch is not overlapped with that of any other switch. The control circuit also performs a second control to individually control at least one of a target current magnitude, flowing through each switch in the switched-on state, and a target on-period length of each switch, and to adjust a ratio of the plurality of light sources in terms of a product of the target current magnitude and the target on-period length.

9 Claims, 18 Drawing Sheets

(56) References Cited

U.S. PATENT DOCUMENTS

2010/0225241 A1* 9/2010 Maehara ..... H05B 33/086 315/250
2010/0270932 A1* 10/2010 Onishi ..... H05B 41/295 315/119
2011/0164103 A1* 7/2011 Kii ..... B41J 2/45 347/118
2012/0043889 A1* 2/2012 Recker ..... H05B 33/0815 315/86
2012/0050618 A1* 3/2012 Ikeda ..... H04N 9/77 348/674
2012/0081009 A1* 4/2012 Shteynberg ..... H05B 33/083 315/122
2012/0187853 A1* 7/2012 Kim ..... H05B 33/0815 315/187
2013/0015774 A1* 1/2013 Briggs ..... H05B 33/0815 315/186
2013/0070796 A1* 3/2013 Belloni ..... H05B 33/0815 372/38.01
2013/0201316 A1* 8/2013 Binder ..... H04L 67/12 348/77
2014/0339995 A1* 11/2014 Zanbaghi ..... H05B 33/0815 315/200 R

FOREIGN PATENT DOCUMENTS

JP 2008-154379 A 7/2008
JP 2009-009817 A 1/2009
JP 2009-302008 A 12/2009
JP 2010-176986 A 8/2010
JP 2010-278366 A 12/2010
JP 2011-034788 A 2/2011
JP 2012-038782 A 2/2012
JP 2012-178255 A 9/2012
JP 2013-058394 A 3/2013

* cited by examiner

ILLUMINATION APPARATUS AND LIGHTING DEVICE USED THEREBY

CROSS-REFERENCE TO RELATED APPLICATION

The disclosure of Japanese Patent Application No. 2013-161484 filed Aug. 2, 2013 including specification, drawings and claims is incorporated herein by reference in its entirety.

TECHNICAL FIELD

The present disclosure relates to an illumination apparatus, and to a lighting device included therein, that causes lighting of a plurality of light sources, differing from one another in terms of light-emission color, and thereby causes the light sources to collectively emit mixed light.

BACKGROUND ART

Typically an illumination apparatus includes a plurality of light sources, differing from one another in terms of light-emission color, in order that the illumination apparatus emits light of a desired light-emission color which is a mixture of light emitted from each of the light sources.

FIG. 18 is a circuit diagram of an illumination apparatus disclosed in Japanese Unexamined Patent Application Publication No. 2009-302008. In FIG. 18, an illumination apparatus 910 includes a light emitting diode (LED) group 903*a* that emits yellow light, an LED group 903*b* that emits green light, an LED group 903*c* that emits blue light, an LED group 903*d* that emits red light, and a lighting device 902 that lights the LED groups 903*a*, 903*b*, 903*c*, and 903*d*. The lighting device 902 includes a direct current (DC) power supply circuit 901, fixed current circuits 905*a*, 905*b*, 905*c* and 905*d* (herein, referred to as fixed current circuits 905 when differentiation is not necessary), and a control circuit 906. The fixed current circuits 905 each have the same structure and each include a switching element Q905 and a resistant element R905.

Each of the fixed current circuits 905 is connected in series to a corresponding one of the LED groups 903*a*, 903*b*, 903*c*, and 903*d*. The LED groups 903*a*, 903*b*, 903*c*, and 904*d* are connected in parallel to one another with respect to the DC power supply circuit 901. The lighting device 902 performs pulse width modulation (PWM) control of the switching element Q905 included in the fixed current circuit 905*a* in order to adjust a duty cycle of the switching element Q905. The above configuration enables the lighting device 902 to adjust magnitude of current flowing through the LED group 903*a* and thus also adjust brightness of the LED group 903*a*. The PWM control and lighting is performed in the same way for each of the LED groups 903*b*, 903*c*, and 903*d*, enabling the lighting device 902 to adjust brightness of each of the LED groups 903*b*, 903*c*, and 903*d*. Chromaticity of mixed light emitted collectively from the LED groups 903*a*, 903*b*, 903*c*, and 903*d* can be adjusted to a desired chromaticity through adjustment of a ratio of the LED groups 903*a*, 903*b*, 903, and 903*d* relative to one another, in terms of brightness thereof.

Note that during PWM control by the control circuit 906, the switching elements Q905 in the fixed current circuits 905 are each switched on at the same timing, but the switching elements Q905 are each switched off individually at a timing in accordance with a duty cycle which is determined for the corresponding switching element Q905. As a result, on-periods of the switching elements Q905 in the fixed current circuits 905, each of which holds the corresponding switching element Q905 in a switched-on state, may be overlapped with one another.

The LED groups 903*a*, 903*b*, 903*c*, and 903*d* each include the same number of LED chips. Note that when current of the same magnitude flows through the LED chips of different emission colors, the LED chips may have different forward voltages from one another due to differences in layer structure and light-emitting layer material of the LED chips. In such a situation, when current of the same magnitude flows through the LED groups 903*a*, 903*b*, 903*c*, and 903*d*, the LED groups 903*a*, 903*b*, 903*c*, and 903*d* have different voltage drops from one another. In the illumination apparatus 910, each of the LED groups 903*a*, 903*b*, 903*c*, and 903*d* is connected in series to a resistant element R in order to compensate for the voltage drop. Through the above configuration, even when the respective on-periods of the switching elements Q905 in the fixed current circuits 905 are overlapped with one another, current concentration is avoided in an LED group having the smallest voltage drop among the LED groups 903*a*, 903*b*, 903*c*, and 903*d*, thereby enabling appropriate current to flow in each of the LED groups 903*a*, 903*b*, 903*c*, and 903*d*.

In order to individually compensate for the voltage drop of each light source, a conventional illumination apparatus such as described above includes resistant elements that are each connected in series to a corresponding one of the light sources. As a consequence, during lighting of the light sources in the conventional illumination apparatus, electric power is disadvantageously consumed in the resistant elements, which are each connected in series to the corresponding light source in order to individually compensate for the voltage drop across the light source.

SUMMARY OF THE INVENTION

One aspect of the present invention is an illumination apparatus including a plurality of light sources, a DC power supply circuit, a plurality of light source switches, and a control circuit. The light sources have different light-emission colors from one another and each have a different voltage drop value when an identical current flows therein. The DC power supply circuit has a pair of output terminals for outputting a DC voltage. The light source switches are each connected in series to a corresponding one of the light sources in one-to-one relationship to form a series circuit that is connected between the output terminals of the DC power supply circuit. The control circuit controls switching of each of the light source switches. The control unit performs a first control configured to control each of the plurality of light source switches by using a time division control method to alternate each of the plurality of light source switches between a switched-on state and a switched-off state such that on-periods of the plurality of light source switches are not overlapped with one another, each of the on-periods holding each of the plurality of light source switches in the switched-on state. The control circuit also performs a second control configured to individually control at least one of a target current magnitude, flowing through each of the plurality of light source switches in the switched-on state, and a target on-period length of each of the plurality of light source switches, and to adjust a ratio of the plurality of light sources in terms of a product of the target current magnitude and the target on-period length.

Alternatively, in the illumination apparatus described above, the control circuit may include a chromaticity table and a chromaticity reading unit. In the chromaticity table a value indicating a target chromaticity that is notified to the control circuit through a chromaticity adjustment signal is linked to at least one of an on-period length of each of the plurality of light source switches and a current magnitude flowing through each of the plurality of light source switches. Upon the chromaticity adjustment signal being inputted to the control circuit the chromaticity reading unit may read out at least one of an on-period length and a current magnitude corresponding to the chromaticity adjustment signal with reference to the chromaticity table, as the at least one of the target on-period length and the target current magnitude.

Alternatively, in the illumination apparatus described above, the second control may control the target current magnitude. In the chromaticity table, the value indicating the target chromaticity may be linked to a current magnitude flowing through each of the light sources. The DC power supply circuit may be a DC-DC converter including a chopping switch for chopping a DC voltage inputted to the DC-DC converter, a pulse oscillator circuit for alternating the chopping switch between a switched-on state and a switched-off state, and a smoothing circuit for smoothing a pulsating current obtained by chopping the DC voltage. Upon the chromaticity adjustment signal being inputted to the control circuit, the chromaticity reading unit may read out the current magnitude linked to the chromaticity adjustment signal, and input the current magnitude to the pulse oscillator circuit. The pulse oscillator circuit may generate a pulse width modulated pulse to adjust a temporal average of current magnitude flowing in each of the plurality of light sources to the current magnitude inputted from the chromaticity reading unit, and output the pulse width modulated pulse to the chopping switch.

Alternatively, in the illumination apparatus described above, the second control may control the target on-period length of each of the plurality of light source switches. In the chromaticity table, the value indicating the target chromaticity may be linked to an on-period length of each of the plurality of light source switches. Upon the chromaticity adjustment signal being inputted to the control circuit, the chromaticity reading unit may read out the on-period length corresponding to the chromaticity adjustment signal from the chromaticity table, and set the on-period length read from the chromaticity table as a time division length of the time division control performed during the first control.

Alternatively, in the illumination apparatus described above, the DC power supply circuit may be a DC-DC converter including a chopping switch for chopping a DC voltage inputted to the DC-DC converter, a pulse oscillator circuit for alternating the chopping switch between a switched-on state and a switched-off state, an inductor into which a pulsating current obtained by chopping the DC voltage flows, and a smoothing circuit for smoothing the pulsating current outputted from the inductor. The first control may predetermine an order in which the plurality of light source switches are to be switched on. The control circuit may detect magnitude of pulsating current flowing through the inductor and upon detecting that the pulsating current flowing through the inductor has a magnitude of zero, the control circuit may switch on one of the plurality of light source switches in accordance with the predetermined order.

Alternatively, in the illumination apparatus described above, upon a luminance signal being input to the control circuit, the control circuit may fix the ratio of the plurality of light sources that is adjusted during the second control, and adjust a sum of the product of the target on-period length and the target current magnitude.

Alternatively, in the illumination apparatus described above, the DC power supply circuit may be a DC-DC converter including a chopping switch for chopping a DC voltage inputted to the DC-DC converter, a pulse oscillator circuit for alternating the chopping switch between a switched-on state and a switched-off state; and a smoothing circuit for smoothing a pulsating current obtained by chopping the DC voltage. The control circuit may include a luminance table and a luminance reading unit. In the luminance table a value indicating a target luminance that is notified to the control circuit through the luminance signal may be linked to a multiplication factor. Upon the luminance signal being inputted to the control circuit, the luminance reading unit may read out the multiplication factor linked to the luminance signal with reference to the luminance table, and output the multiplication factor to the pulse oscillator circuit. The pulse oscillator circuit may generate a pulse width modulated pulse to adjust a temporal average of current magnitude flowing in each of the plurality of light sources to a current magnitude obtained by multiplying the multiplication factor by the current magnitude adjusted during the second control, and output the pulse width modulated pulse to the chopping switch.

Alternatively, in the illumination apparatus described above, the first control may predetermine time division lengths of the time division control performed during the first control. The control circuit may include a luminance control unit that, upon the luminance signal being inputted to the control circuit, adjusts a ratio of a target on-period length to each of the time division lengths in accordance with the luminance signal.

Alternatively, in the illumination apparatus described above, the control circuit may include a sensor for detecting abnormity of the DC power supply circuit. Upon the sensor detecting the abnormity of the DC power supply circuit, the control circuit may switch off all of the plurality of light source switches.

Another aspect of the present invention is a lighting device for lighting a plurality of light sources having different light-emission colors from one another and each having a different voltage drop value when an identical current flows therein. The lighting device includes a DC power supply circuit, a plurality of light source switches, and a control circuit. The DC power supply circuit has a pair of output terminals for outputting a DC voltage. The light source switches are each connected in series to a corresponding one of the light sources in one-to-one relationship to form a series circuit that is connected between the output terminals of the DC power supply circuit. The control circuit controls switching of each of the light source switches. The control unit performs a first control configured to control each of the plurality of light source switches by using a time division control method to alternate each of the plurality of light source switches between a switched-on state and a switched-off state such that on-periods of the plurality of light source switches are not overlapped with one another, each of the on-periods holding each of the plurality of light source switches in the switched-on state. The control circuit also performs a second control configured to individually control at least one of a target current magnitude, flowing through each of the plurality of light source switches in the switched-on state, and a target on-period length of each of the plurality of light source switches, and to adjust a ratio of the plurality of light sources in terms of a product of the target current magnitude and the target on-period length.

In the illumination apparatus relating to the one aspect of the present invention, the control circuit performs on-off switching of each of the light sources in a manner such that an on-period of the light source switch is not overlapped with an on-period of any other of the light source switches. According to the above configuration, the light sources emit light in order, one at a time, and thus current does not simultaneously flow in each of the light sources. As a consequence of the above, it is not necessary to connect a resistant element in series to each of the light sources in order to individually compensate for voltage drop across the light source. Therefore, the illumination apparatus having the above configuration enables reduced power consumption relative to the conventional illumination apparatus described further above. Furthermore, in the illumination apparatus having the above configuration, chromaticity of mixed light emitted collectively from the light sources can be adjusted to a desired chromaticity by adjusting the products of target on-period length and target current magnitude for the light sources, thereby adjusting a ratio of the light sources relative to one another, in terms of a product, for each of the light sources, of luminance and light-emission time.

Consequently, the above configuration enables reduction in power consumption for an illumination apparatus including a plurality of light sources differing in terms of light-emission color and also in terms of voltage drop thereacross during light-emission.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DETAILED DESCRIPTION

First Embodiment

The following explains, with reference to FIGS. 1-4, an illumination apparatus relating to a first embodiment of the present invention. Note that the first embodiment is explained for an example in which LEDs are used as light sources.

1. Circuit Configuration

Figure 1:
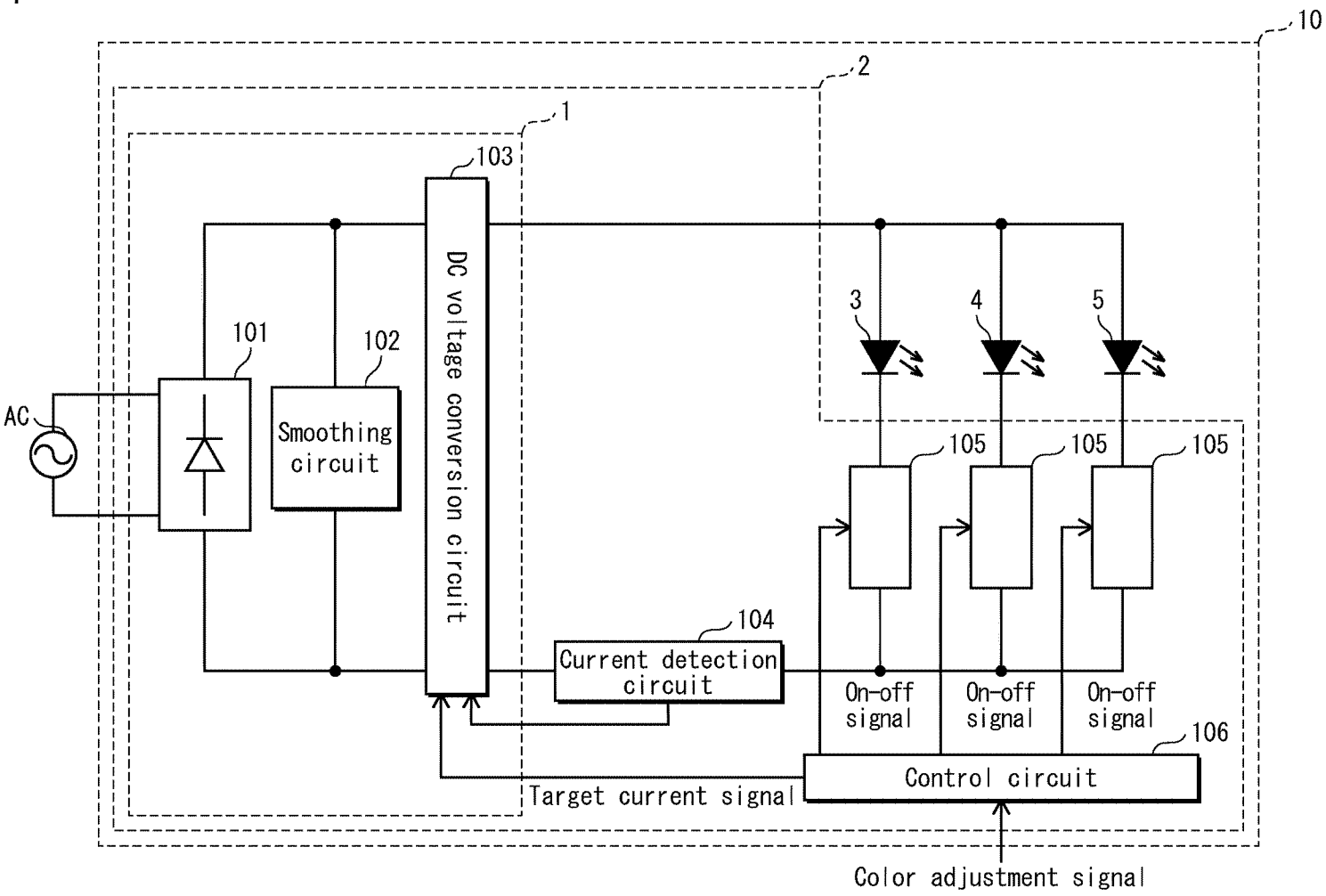
FIG. 1 is a block diagram of an illumination apparatus relating to an embodiment of the present invention.

As illustrated by the block diagram in FIG. 1, an illumination apparatus 10 includes a lighting device 2 and LEDs 3, 4, and 5. The LEDs 3, 4, and 5 differ from one another in terms of light-emission color. In the present embodiment, light-emission colors of the LEDs 3, 4, and 5 are for example red (R), green (G), and blue (B) respectively. The lighting device 2 lights the LEDs 3, 4, and 5 in order, one at a time, at a high speed such that a person is unable to perceive flashing on and off of the LEDs 3, 4, and 5. The above configuration makes it possible to obtain mixed light by mixing light-emission colors of the LEDs 3, 4, and 5. When lighting the LEDs 3, 4, and 5 one by one, the lighting device 2 adjusts a ratio of the LEDs 3, 4, and 5 in terms of brightness to a predetermined ratio. The above configuration enables adjustment of chromaticity of the mixed light so as to match a predetermined chromaticity. More specifically, the lighting device 2 includes a DC power supply circuit 1, a current detection circuit 104, three light source switches 105, and a control circuit 106. The following provides detailed explanation of circuitry within the lighting device 2 with reference to the circuit diagram illustrated in FIG. 2.

2. Configuration of Elements (DC Power Supply Circuit)

The DC power supply circuit 1 includes a full-wave rectifier circuit 101, a smoothing circuit 102, and a DC voltage conversion circuit 103.

The full-wave rectifier circuit 101 is a diode bridge circuit. Explanation of detailed operation of the full-wave rectifier circuit 101 is omitted as such operation is common knowledge.

The smoothing circuit 102 is a power factor improvement type of step-up chopper circuit. The smoothing circuit 102 includes an inductor L1, a field effect transistor (FET) Q1 (herein, referred to simply as a switching element Q1), a diode D1, a capacitor C1, and a resistant element R1 which detects current flowing through the switching element Q1.

The DC voltage conversion circuit 103 is a step-down chopper circuit. The DC voltage conversion circuit 103 includes an inductor L2, an FET Q2 (herein, referred to simply as a switching element Q2), a capacitor C2, a diode D2, and a micro-computer IC1. The switching element Q2 functions as a chopping switch that chops DC voltage inputted thereto, and outputs pulsating current to the inductor L2. The switching element Q2 has an operating frequency of, for example, tens to hundreds of kilohertz. The capacitor C2 smoothes the current outputted from the inductor L2. The micro-computer IC1 for example includes a pulse oscillator circuit that performs PWM control of the switching element Q2 and a protection circuit that inhibits excessive flow of current through the switching element Q2. The micro-computer IC1 receives a target current signal from the control circuit 106, indicating a target current magnitude for output current from the DC voltage conversion circuit 103. The micro-computer IC1 also receives an output current signal from the current detection circuit 104 indicating an actual current magnitude of output current from the DC voltage conversion circuit 103. The micro-computer IC1 performs PWM control on the switching element Q2 such that the target current signal and the output current signal match one another. The above configuration enables adjustment of output current from the DC power supply circuit 1 so as to match the target current magnitude.

(Current Detection Circuit)

The current detection circuit 104 detects output current I1 from the DC voltage conversion circuit 103. The current detection circuit 104 is a resistant element R2 having a fixed resistance.

(Light Source Switches)

The light source switches 105 are implemented as switching elements Q3, Q4, and Q5, each of which is a metal oxide semiconductor field effect transistor (MOSFET). The switching elements Q3, Q4, and Q5 are respectively connected in series to the LEDs 3, 4, and 5 in one-to-one correspondence. The LED 3 and the switching element Q3 form a series circuit that is connected between a pair of output terminals of the DC power supply circuit 1. Likewise, a series circuit formed by the LED 4 and the switching element Q4, and a series circuit formed by the LED 5 and the switching element Q5, are each connected between the output terminals of the DC power supply circuit 1.

(LEDs)

Figure 2:
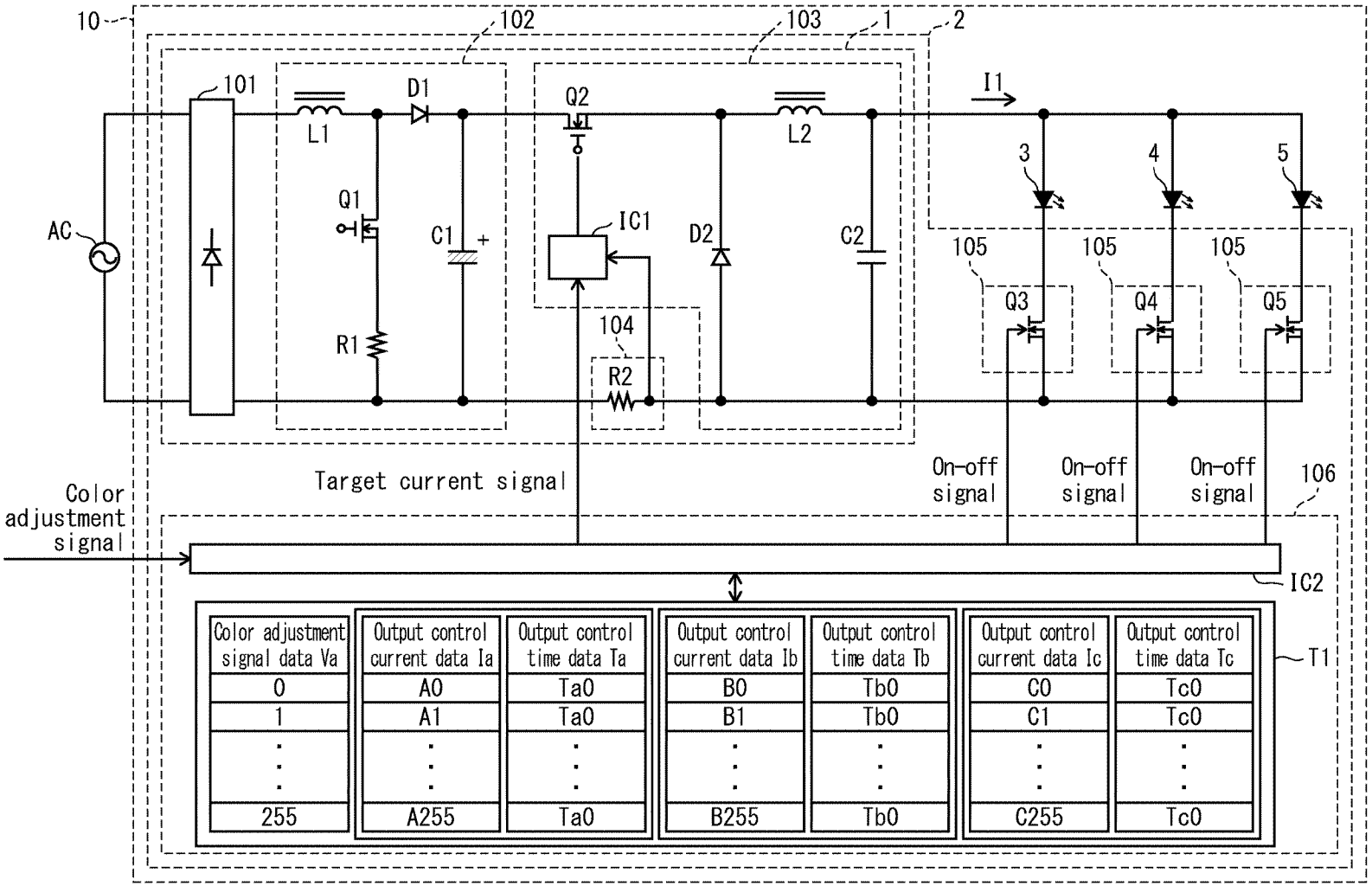
FIG. 2 is a circuit diagram of the illumination apparatus illustrated in FIG. 1.

Note that although the LEDs 3, 4, and 5 are each illustrated as a single LED in FIG. 2, the LEDs 3, 4, and 5 may alternatively each be a plurality of LEDs that have the same properties and that are connected in series. As a consequence of the LEDs 3, 4, and 5 having different light-emission colors, the LEDs 3, 4, and 5 differ from one another in terms of, for example, layer structure and materials. Therefore, the LEDs 3, 4, and 5 also differ from one another in terms of forward voltage when current of a certain magnitude flows therein. When current of 10 mA flows through LEDs of R, G, and B light-emission colors, typically respective forward voltages of the R, G, and B LEDs are approximately 1.8 V, approximately 2.4 V, and approximately 3.6 V.

(Control Circuit)

The control circuit 106 includes a micro-computer IC2 and a chromaticity table T1. The micro-computer IC2 controls output current from the DC voltage conversion circuit 103 by transmitting a target current signal to the micro-computer IC1. The micro-computer IC2 also performs on-off control of each of the switching elements Q3, Q4, and Q5 by transmitting an on-off signal to the corresponding switching element. The micro-computer IC2 includes a timer that measures time and a memory in which data read from the chromaticity table T1 is set. The chromaticity table T1 includes color adjustment signal data Va, output control current data Ia, Ib and Ic, and output control time data Ta, Tb and Tc. The color adjustment signal data Va are preset values for chromaticity of mixed light emitted from the LEDs 3, 4, and 5, which have 256 different values ranging from 0 to 255. The output control current data Ia, Ib, and Ic are target current magnitudes for current flowing through the LEDs 3, 4, and 5 respectively. In other words, the output control current data Ia, Ib, and Ic respectively indicate luminance of the LEDs 3, 4, and 5 during light-emission. The output control time data Ta, Tb, and Tc are on-period lengths of the switching elements Q3, Q4, and Q5 respectively. In other words, the output control time data Ta, Tb, and Tc respectively indicate lengths of time that the LEDs 3, 4, and 5 are caused to emit light. Values of the output control current data Ia, Ib and Ic, and the output control time data Ta, Tb and Tc, are set with respect to each of the 256 different values of the color adjustment signal data Va. For example, when the color adjustment signal data Va has a value of 0, corresponding values of the aforementioned output current control data Ia, Ib and Ic, and the output control time data Ta, Tb and Tc, are respectively A0, B0, C0, Ta0, Tb0, and Tc0. In terms of chromaticity of mixed light emitted from the LEDs 3, 4, and 5, in a situation in which, for example, the illumination apparatus is to be used for general illumination, 256 different values for chromaticity are preset from incandescent to neutral white in accordance with a blackbody locus and CIE daylight. Alternatively, in a situation in which, for example, the illumination apparatus is to be used in a specialized type of illumination, 256 different values for chromaticity may be freely preset as appropriate for the intended use. In the present embodiment, 256 different values of output control current data Ia are present in the chromaticity table T1, ranging from A0 to A255. The same also applies to the output control current data Ib and Ic. The output control time data Ta is fixed at a constant value Ta0 regardless of the color adjustment signal data Va. Likewise, the output control time data Tb and Tc are fixed at constant values of Tb0 and Tc0 respectively. Note that in the present example, Ta0, Tb0, and Tc0 each have the same value. In other words, in the chromaticity table T1, the output control current data Ia, Ib, and Ic are each changed for every color adjustment signal data Va, but the output control time data Ta, Tb, and Tc are each fixed at a constant value. Thus, as described above, the chromaticity table T1 includes output control current data Ia, Ib, and Ic, respectively corresponding to current magnitudes for the LEDs 3, 4, and 5, which are linked to the color adjustment signal data Va.

2. Control Circuit Operational Flow

The control circuit 106 executes a control program. The following explains operational flow of the control program with reference to FIG. 3.

First, upon the control circuit 106 being started-up by switching on a power source, the control circuit 106 reads values of the output control current data Ia, Ib and Ic, and the output control time data Ta, Tb, and Tc from the memory (Step S001). The memory stores the values of the output control current data Ia, Ib and Ic, and the output control time data Ta, Tb and Tc from a previous lighting operation. The control circuit 106 resets the timer (Step S002), and subsequently outputs a target current signal indicating the value of the output control current data Ia to the micro-computer IC1, switches on the switching element Q3, and switches off the switching elements Q4 and Q5 (Step S003). The micro-computer IC1 receives the target current signal and adjusts output current of the DC voltage conversion circuit 103 to match Ia. More specifically, the pulse oscillator circuit generates a pulse width modulated pulse and inputs the pulse to the switching element Q2 such that a temporal average of current flowing through the LED 3 becomes equal to a current magnitude indicated by the output control current data Ia. Through the above, among the LEDs 3, 4, and 5, current Ia only flows through the LED 3 and only the LED 3 emits light of a luminance in accordance with magnitude of current Ia.

Once time indicated by the timer matches the output control time data Ta (Step S004: Yes), the control circuit 106 resets the timer (Step S005). The control circuit 106 subsequently outputs a target current signal indicating the value of the output control current data Ib to the micro-computer IC1, switches the switching element Q4 on, and switches the switching elements Q3 and Q5 off (Step S006). The micro-computer IC1 receives the target current signal and adjusts output current from the DC voltage conversion circuit 103 to match Ib. Through the above, among the LEDs 3, 4, and 5, current Ib only flows through the LED 4 and only the LED 4 emits light of a luminance in accordance with magnitude of current Ib.

Once time indicated by the timer matches the output control time data Tb (Step S007: Yes), the control circuit 106 resets the timer (Step S008). The control circuit 106 subsequently outputs a target current signal indicating the value of the output control current data Ic to the micro-computer IC1, switches the switching element Q5 on, and switches the switching elements Q3 and Q4 off (Step S009). The micro-computer IC1 receives the target current signal and adjusts output current from the DC voltage conversion circuit 103 to match Ic. Through the above, among the LEDs 3, 4, and 5, current Ic only flows through the LED 5 and only the LED 5 emits light of a luminance in accordance with magnitude of current Ic.

Once time indicated by the timer matches the output control time data Tc (Step S010: Yes), if not acquiring color adjustment signal data Va from the outside (Step S011: No), the control circuit 106 reads out the output control current data Ia, Ib and Ic, and the output control time data Ta, Tb and Tc from the memory (Step S001). The control circuit 106 repeats Steps S002 to S011. On the other hand, if acquiring color adjustment signal data Va from the outside (Step S011: Yes), the control circuit 106 selects and reads the output control current data Ia, Ib and Ic, and the output control time data Ta, Tb and Tc from the chromaticity table T1, in accordance with the color adjustment signal data Va, and memorizes the output control current data Ia, Ib and Ic, and output control time data Ta, Tb and Tc, which are selected above, in the memory (Step S012). During performance of Step S012, the control circuit 106 functions as a chromaticity reading unit. The above operation enables adjustment of color of the mixed light. For example, when the color adjustment signal data Va has a value of 0, the values of A0, B0, and C0 are respectively selected as values of the output control current data Ia, Ib, and Ic; in the same way, the values of Ta0, Tb0, and Tc0 are respectively selected as values of the output control time data Ta, Tb, and Tc. Likewise, even when the color adjustment signal data Va has a value other than 0, a set of values corresponding to the value other than 0 in the chromaticity table T1 is selected as values of the output control current data Ia, Ib, and Ic, and the output control time data Ta, Tb, and Tc. Subsequently, the control circuit 106 once again reads the values of the output control current data Ia, Ib and Ic, and the output control time data Ta, Tb and Tc from the memory (Step S001), and also repeats Steps S002 to S011. Note that a color adjustment signal is transmitted to the control circuit 106, for example, upon being selected by a user using a remote controller (not illustrated).

Figure 4:
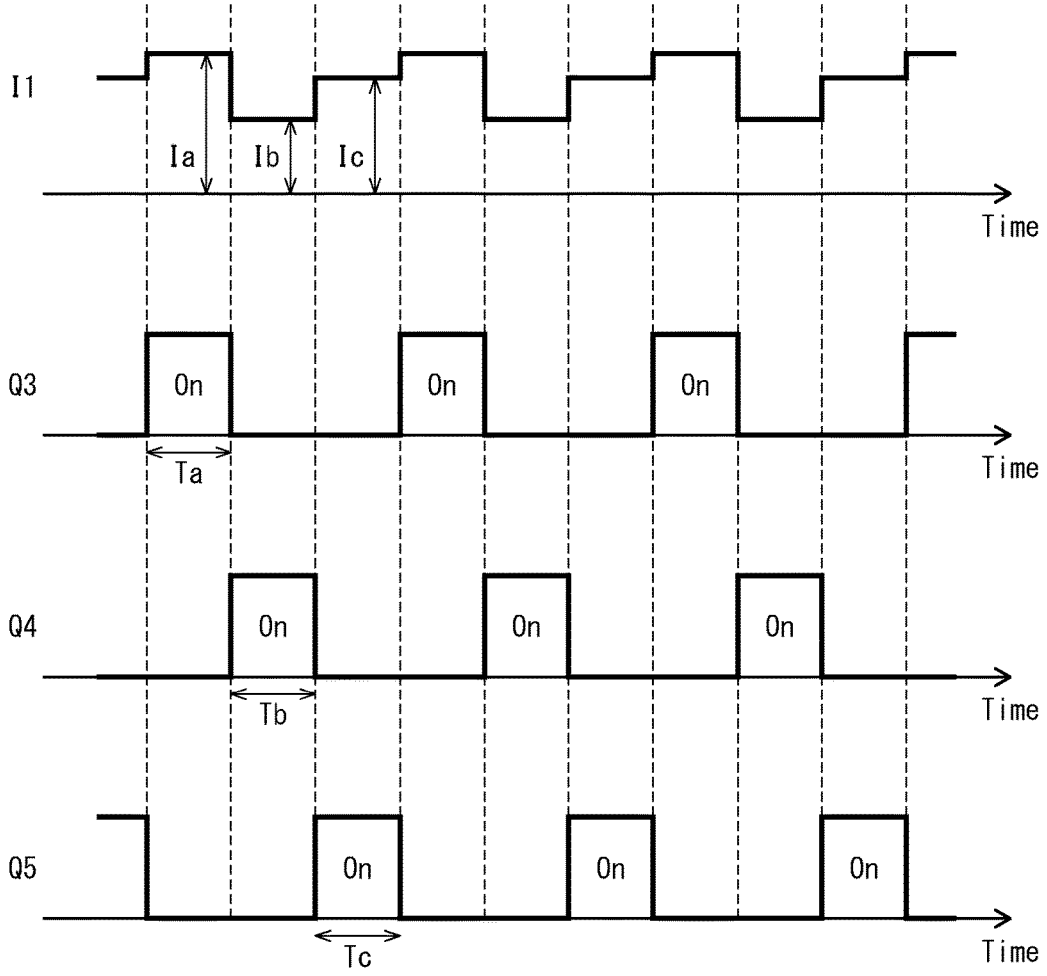
FIG. 4 is a waveform diagram of DC output from a DC power supply circuit and voltage output to respective gates of switching elements Q3, Q4, and Q5 in the illumination apparatus illustrated in FIG. 1.

As a result of the control circuit 106 operating as described above, output current I1 from the DC voltage conversion circuit 103 and on-off states of the switching elements Q3, Q4, and Q5 vary over time as illustrated in the waveform diagram in FIG. 4. Also, through control by the control circuit 106, time division control is performed on the switching elements Q3, Q4, and Q5 such that the switching elements Q3, Q4, and Q5 are each switched to a switched-on state in accordance with a predetermined order. Note that on-periods of the switching elements Q3, Q4, and Q5, each of which holds the corresponding switching element in a switched-on state, are not overlapped with one another. Luminance of each of the LEDs 3, 4, and 5 depends on magnitude of current flowing therein. Also, light-emission time of the LED 3 is equal to on-period length of the switching element Q3, and likewise light-emission times of the LEDs 4 and 5 are respectively equal to on-period lengths of the switching elements Q4 and Q5. Furthermore, for each of the LEDs 3, 4, and 5, visual brightness of the corresponding LED depends on a product of luminance and light-emission time of the LED. Consequently, a ratio of the LEDs 3, 4, and 5 in terms of the aforementioned product of luminance and light-emission time is adjusted to match a predetermined ratio, thereby adjusting chromaticity of mixed light of the LEDs 3, 4, and 5 to a desired chromaticity. Note that, a total period in which all of the switching elements Q3, Q4, and Q5 are switched on one by one by using a time division control method is defined as one cycle. When the one cycle (i.e., Ta+Tb+Tc) has a period of approximately 15 ms or less, it is possible to inhibit visible flickering of the mixed light emitted from the LEDs 3, 4, and 5. Further, when the one cycle (i.e., Ta+Tb+Tc) has a period of approximately 10 ms or less, visual flickering of the mixed light emitted from the LEDs 3, 4, and 5 can be inhibited to a greater degree.

Note that although output current I1 from the DC voltage conversion circuit 103 is illustrated as being of constant magnitude during the respective on-periods of the switching elements Q3, Q4, and Q5, the above is not a limitation. For example, during the on-period of each of the switching elements Q3, Q4, and Q5, output current I1 may be large directly after the corresponding switching element is switched-on, and may gradually decrease as the on-period progresses. In such a situation, temporal averages of output current I1 during the respective on-periods of the switching elements Q3, Q4, and Q5 should be adjusted to respectively match the values of the output control current data Ia, Ib, and Ic.

In the present embodiment, output current I1 to be outputted from the DC voltage conversion circuit 103 is adjusted, by using the chromaticity table T1, based on a color adjustment signal inputted to the control circuit 106 from the outside, but the above is not a limitation. For example, alternatively predetermined output control current data Ia, Ib, and Ic are inputted to the control circuit 106 from the outside and, by using the aforementioned output control current data, output current I1 outputted from the DC voltage conversion circuit 103 may be adjusted.

3. Effects

The illumination apparatus 10 includes the plurality of LEDs (i.e., light sources) 3, 4, and 5, the plurality of switching elements (i.e., light source switches) Q3, Q4, and Q5, the DC voltage conversion circuit 103, and the control circuit 106. The plurality of LEDs (light sources) 3, 4, and 5 differ from one another in terms of light-emission color and also in terms of voltage drop thereacross when current of identical magnitude flows therein. The plurality of switching elements (light source switches) Q3, Q4, and Q5 are respectively connected in series to the LEDs (light sources) 3, 4, and 5 in one-to-one correspondence. The DC voltage conversion circuit 103 has a pair of output terminals for outputting DC voltage. Between the pair of output terminals, series circuits are connected. Each of the series circuits consists of a corresponding one of the LEDs (light sources) 3, 4, and 5 and a corresponding one of the switching elements (light source switches) Q3, Q4, and Q5 connected in series thereto. The control circuit 106 controls switching of each of the switching elements (light source switches) Q3, Q4, and Q5. The control circuit 106 performs a first control and a second control. In the first control, the switching elements (light source switches) Q3, Q4, and Q5 are controlled by a time division control method to switch between a switched-on state and a switched-off state such that an on-period of one switching element among the switching elements (light source switches) Q3, Q4, and Q5, which holds the one switching element (light source switch) in the switched-on state, is not overlapped with an on-period of another switching element. In the second control, the control circuit 106 individually controls a target current magnitude, flowing through each of the light source switches in the switched-on state, and/or a target on-period length and adjusts a ratio of the LEDs (light sources) 3, 4, and 5 in terms of a product of a target on-period length and a target current magnitude.

Through the above configuration, in the illumination apparatus 10, the three LEDs 3, 4, and 5 emit light in order, one at a time, and current does not flow simultaneously through the LEDs 3, 4, and 5. Consequently, it is not necessary to connect a resistant element in series to each light source (i.e., the LEDs 3, 4, and 5) in order to individually compensate for voltage drop across the corresponding light source. As a consequence, use of the lighting device 2 enables reduction in power consumption during light-emission, as compared with the case where each of the LEDs 3, 4, and 5 is connected in series to a resistant element whose resistance is adjusted.

The lighting device 2 adjusts a ratio of the LEDs 3, 4, and 5 relative to one another, in terms of a product of luminance and light-emission time thereof, in accordance with a color adjustment signal input from the outside. The above configuration enables the lighting device 2 to adjust chromaticity of mixed light emitted from the LEDs 3, 4, and 5.

The lighting device 2 has preset 256 different values for chromaticity. The aforementioned color adjustment signal is used to select one of the preset values for chromaticity. Consequently, a user can perform color adjustment simply by selecting one of the preset values for chromaticity. An advantageous effect of the above is that the user is able to easily select a desired chromaticity.

In the lighting device 2, if target chromaticity varies, chromaticity of mixed light emitted from the LEDs 3, 4, and 5 is adjusted by changing output currents Ia, Ib, and Ic from the DC voltage conversion circuit 103 while fixing on-period lengths Ta, Tb, and Tc of the switching elements Q3, Q4, and Q5. More specifically, in the chromaticity table T1, values of Ta, Tb and Tc are the same regardless of which target chromaticity is selected, whereas a ratio of values of Ia, Ib, and Ic changes for each different target chromaticity. Thus, the number of preset data is reduced as compared with the case where both output currents Ia, Ib, and Ic, and on-period lengths Ta, Tb, and Tc are changed. Therefore, the above configuration enables reduction in memory capacity of the micro-computer IC2. Furthermore, the above configuration prevents on-off switching frequency of the switching elements Q3, Q4, and Q5 from becoming excessively high. Therefore, the switching elements Q3, Q4, and Q5 may be implemented as switching elements that only have low frequency properties.

Second Embodiment

Figure 5:
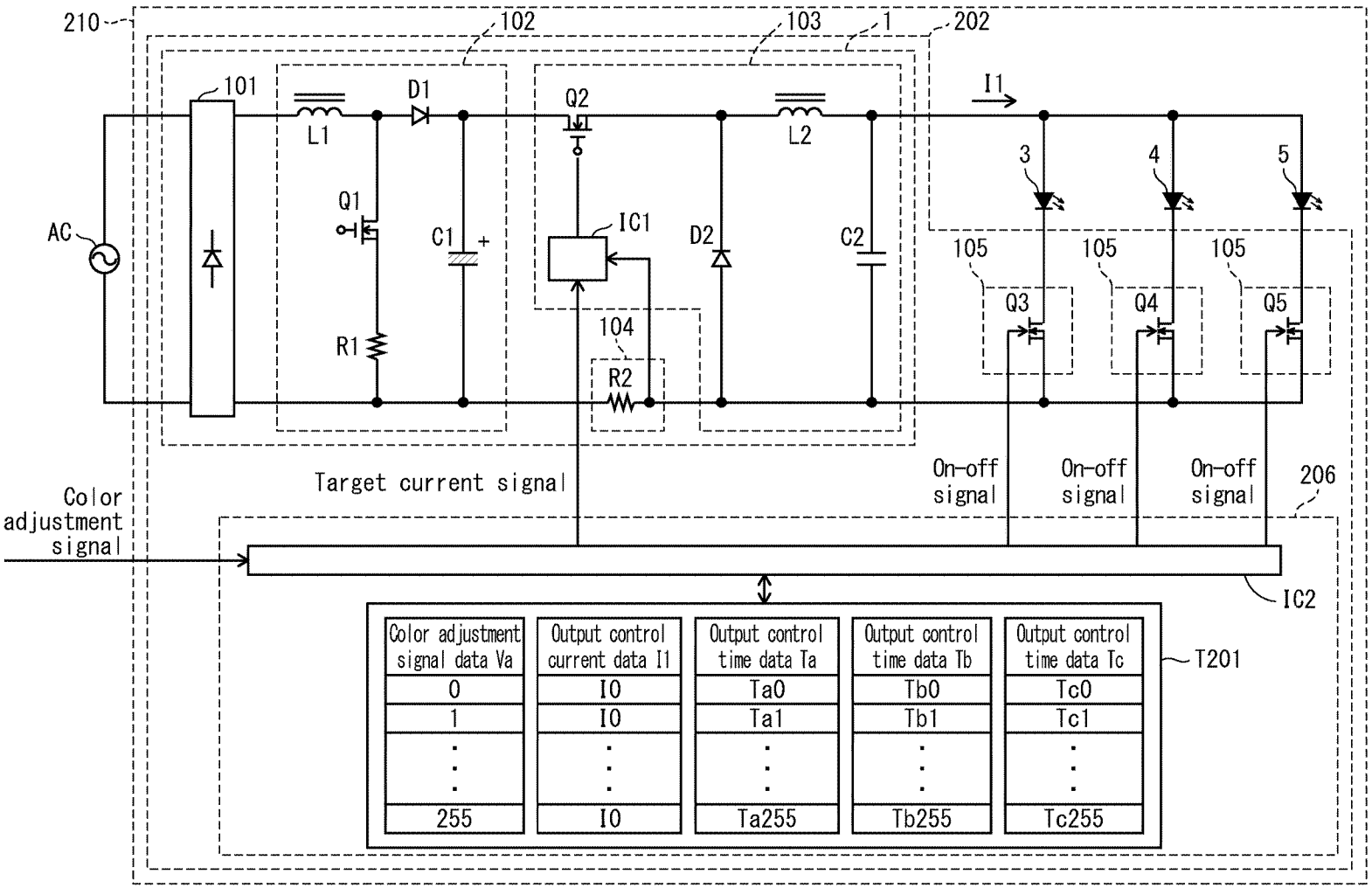
FIG. 5 is a circuit diagram of an illumination apparatus relating to an embodiment of the present invention.
Figure 6:
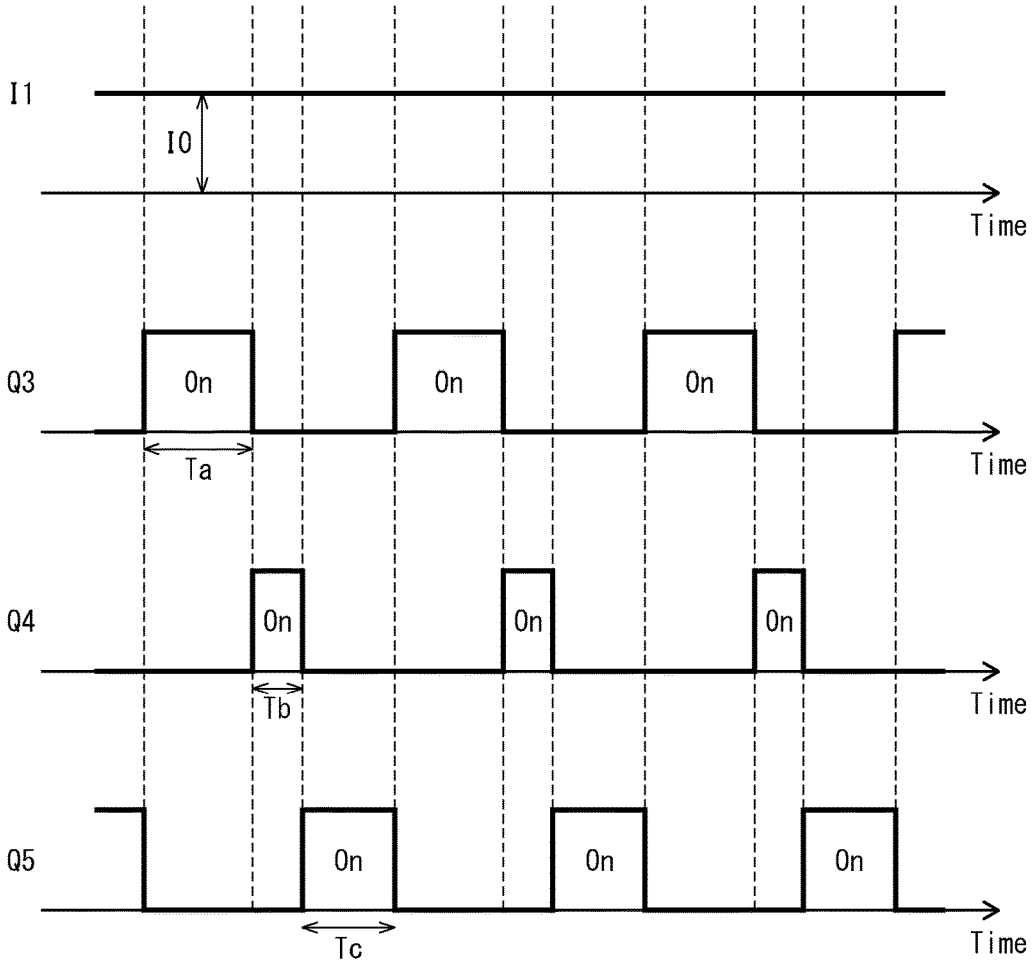
FIG. 6 is a waveform diagram of DC output from a DC power supply circuit and voltage output to respective gates of switching elements Q3, Q4, and Q5 in the illumination apparatus illustrated in FIG. 5.

The following explains a second embodiment of the present invention with reference to the circuit diagram in FIG. 5 and the waveform diagram in FIG. 6. The second embodiment differs from the first embodiment in terms that when target chromaticity indicated by a color adjustment signal varies, a ratio of switches in terms of on-period length is changed for every color adjustment signal data, while output current from a DC voltage conversion circuit remains fixed at a constant value. The following explanation focuses on differences between the first embodiment and the second embodiment. Elements of configuration which are the same as in the first embodiment are labeled using the same reference signs and explanation thereof is omitted.

As illustrated by the circuit diagram in FIG. 5, an illumination apparatus 210 includes a lighting device 202. The lighting device 202 includes a control circuit 206. The control circuit 206 includes a micro-computer IC2 and a chromaticity table T201. In the chromaticity table T201, output control current data I1 indicating target current magnitude for output current from a DC voltage conversion circuit 103, and output control time data Ta, Tb, and Tc respectively indicating on-period lengths of switching elements Q3, Q4, and Q5 are set in advance. In other words, in the chromaticity table T201, each value of color adjustment signal data Va is linked to values of output control time data Ta, Tb, and Tc, which respectively correspond to on-period lengths for the switching elements Q3, Q4, and Q5. Output control current data I1 is fixed at a constant value I0 regardless of the color adjustment signal data Va. On the other hand, 256 different values of the output control time data Ta are present in the chromaticity table T201, ranging from Ta0 to Ta255. The same also applies to the output control time data Tb and Tc. In other words, in the chromaticity table T201, output control current data I1 is fixed at a constant value of I0, and the output control time data Ta, Tb, and Tc are changed for every color adjustment signal data Va.

Figure 3:
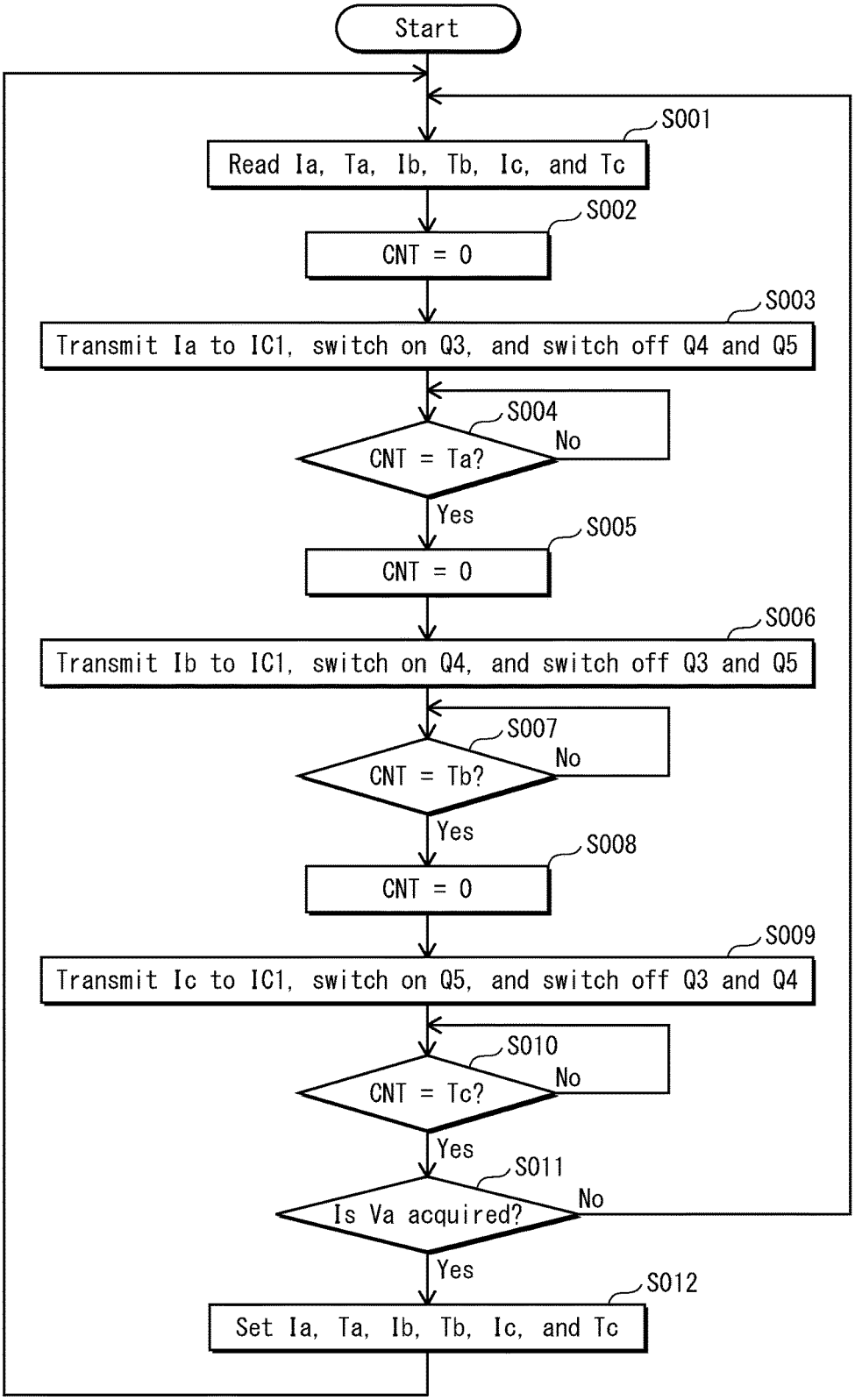
FIG. 3 is a flowchart of operation of a control circuit illustrated in FIG. 1.

Upon input of a color adjustment signal from externally to the micro-computer IC2, the micro-computer IC2 selects and reads, from the chromaticity table T201, output control current data I1 indicating current that flows in each of the LEDs 3, 4, and 5, and output control time data Ta, Tb, and Tc respectively indicating on-period lengths for the switching elements Q3, Q4, and Q5, based on the color adjustment signal data Va determined by the color adjustment signal. The micro-computer IC2 memorizes the output control current data I1 and the output control time data Ta, Tb, and Tc in the memory. Through the above, the output control time data Ta, Tb, and Tc are determined as respective lengths of the divided time when the switching elements Q3, Q4, and Q5 are controlled by using a time division control method. As a result of control performed by the control circuit 106 as illustrated in FIG. 3, output current I1 from the DC voltage conversion circuit 103 is fixed at a constant value I0, and respective on-period lengths of the switching elements Q3, Q4, and Q5 are individually controlled, as illustrated by the waveform diagram in FIG. 6. In the present embodiment, the product of the output current I1 from the DC voltage conversion circuit 103 and the on-period length each of the switching elements Q3, Q4, and Q5 indicates the same value as that of the waveform diagram illustrated in FIG. 4. As a consequence, the product of the luminance of each of the LEDs 3, 4, and 5 and the light-emission time thereof has the same value as that of the waveform diagram illustrated in FIG. 4. The waveform diagram in FIG. 4 has therefore the same ratio of the LEDs 3, 4, and 5 in terms of the product of the luminance and the light-emission time as that of the waveform diagram in FIG. 6. This causes the mixed light emitted from the LEDs 3, 4, and 5 to have the same light emission color.

The lighting device 202 enables color adjustment of the mixed light emitted from the LEDs 3, 4, and 5, in accordance with a color adjustment signal input from externally thereto, by adjusting on-period lengths Ta, Tb, and Tc, while fixing the output control current data at a value of I0. The above configuration enables inhibition of excessive large current being outputted from the switching element Q2 Inhibiting excessive large current outputted from the switching element Q2 prevents breakdown of the switching element Q2 due to stress.

Third Embodiment

Color of mixed light is adjusted in the first embodiment through adjustment of a ratio of magnitudes of output current from the DC voltage conversion circuit, and is adjusted in the second embodiment through adjustment of a ratio of on-period lengths of the switching elements. In contrast to the first and second embodiments, in a third embodiment of the present invention, color of mixed light is adjusted through adjustment of both a ratio of magnitudes of output current from a DC voltage conversion circuit and a ratio of on-period lengths of switching elements.

Figure 7:
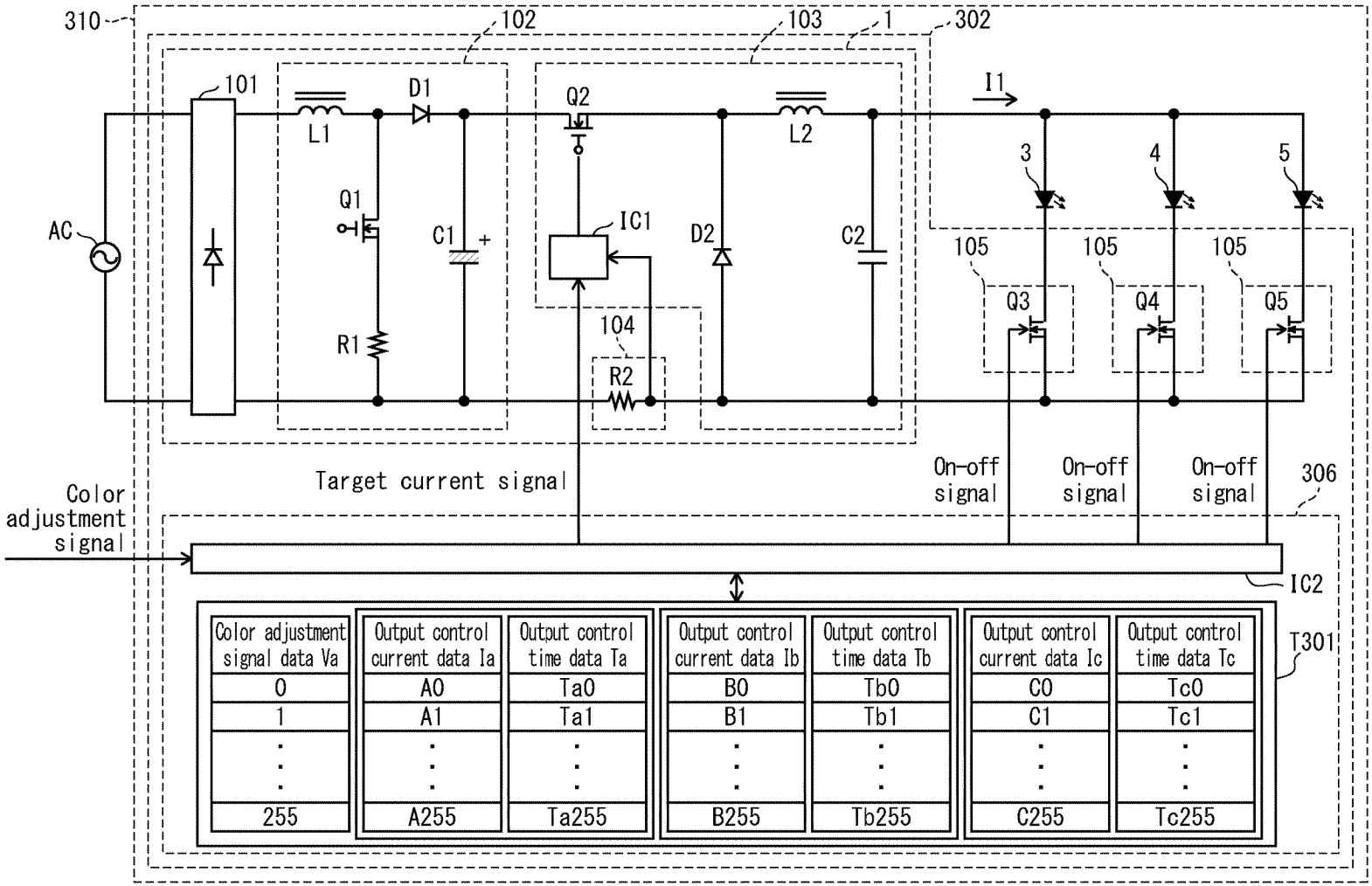
FIG. 7 is a circuit diagram of an illumination apparatus relating to an embodiment of the present invention.
Figure 8:
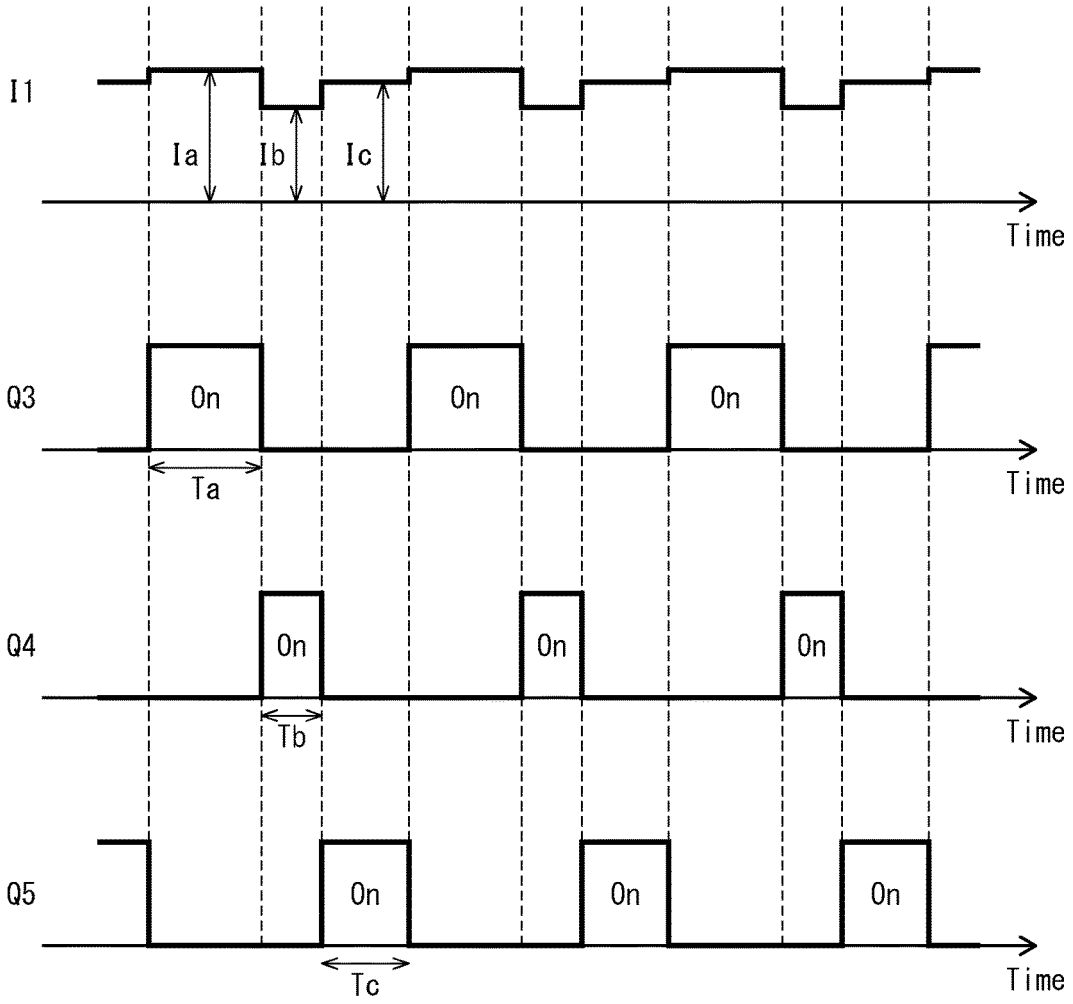
FIG. 8 is a waveform diagram of DC output from a DC power supply circuit and voltage output to respective gates of switching elements Q3, Q4, and Q5 in the illumination apparatus illustrated in FIG. 7.

The following explains the third embodiment with reference to the circuit diagram in FIG. 7 and the waveform diagram in FIG. 8. The third embodiment differs from the first embodiment in terms that a ratio of magnitudes of output current from a DC voltage conversion circuit is adjusted while also adjusting a ratio of on-period lengths of switches. The following explanation focuses on differences between the first embodiment and the third embodiment. Elements of configuration which are the same as in the first embodiment are labeled using the same reference signs and explanation thereof is omitted.

As illustrated by the circuit diagram in FIG. 7, an illumination apparatus 310 includes a lighting device 302. The lighting device 302 includes a control circuit 306. The control circuit 306 includes a micro-computer IC2 and a chromaticity table T301. In the chromaticity table T301, output control current data Ia, Ib, and Ic indicating target current magnitudes for output current from DC voltage conversion circuit 103, and output control time data Ta, Tb, and Tc respectively indicating on-period lengths for switching elements Q3, Q4, and Q5, are set in advance. In other words, for each color adjustment signal data Va, both the output control current data Ia, Ib, and Ic, and the output control time data Ta, Tb, and Tc are described in the chromaticity table T301. Herein, the output control current data Ia, Ib, and Ic, correspond to respective current magnitudes for the LEDs 3, 4, and 5. The output control time data Ta, Tb, and Tc, correspond to respective on-period lengths for the switching elements Q3, Q4, and Q5. The output control current data has 256 different values ranging from A0 to A255. The same also applies to the output control current data Ib and Ic. Likewise, the output control time data Ta has 256 different values ranging from Ta0 to Ta255. The same also applies to the output control time data Tb and Tc. In other words, in the chromaticity table T301, the output control current data Ia, Ib, and Ic, and the output control time data Ta, Tb, and Tc are changed in value for every color adjustment signal data Va.

The micro-computer IC2 selects the output control current data Ia, Ib, and Ic, and the output control time data Ta, Tb, and Tc from the chromaticity table T301 in accordance with the color adjustment signal data Va, and memorizes the output control current data Ia, Ib, and Ic, and the output control time data Ta, Tb, and Tc, which are described above, in the memory. As a result of control performed by the control circuit 306, output current I1 from the DC voltage conversion circuit 103 is individually controlled for each the LEDs 3, 4, and 5, and on-period length is individually controlled for each the switching elements Q3, Q4, and Q5, as illustrated by the waveform diagram in FIG. 8. In the present embodiment, the product of output current I1 from the DC voltage conversion circuit 103 and on-period length of each of the switching elements Q3, Q4, and Q5 has the same value as that of the waveform diagram in FIG. 4. As a consequence, the product of luminance of each of the LEDs 3, 4, and 5, and light-emission time thereof has the same value as that of the waveform diagram illustrated in FIG. 4. The waveform diagram in FIG. 4 has therefore the same ratio of the LEDs 3, 4, and 5 in terms of the product of the luminance and the light-emission time thereof as that of the waveform diagram in FIG. 8. This causes mixed light emitted from the LEDs 3, 4, and 5 to have the same light emission color.

The lighting device 302 enables color adjustment of mixed light emitted from the LEDs 3, 4, and 5 through adjustment of both a ratio of output currents Ia, Ib, and Ic from the DC voltage conversion circuit 103, and a ratio of on-period lengths of the switching elements Q3, Q4, and Q5. The above configuration enables a wider range of color adjustment of mixed light emitted from the LEDs 3, 4, and 5. More specifically, to realize mixed light significantly affected by color components of the LED 3, the output control current data Ia for the LED 3 may be increased, and additionally the output control time data Ta, which serves as on-period length of the switching element Q3 for lighting the LED 3, may be increased.

Fourth Embodiment

Figure 9:
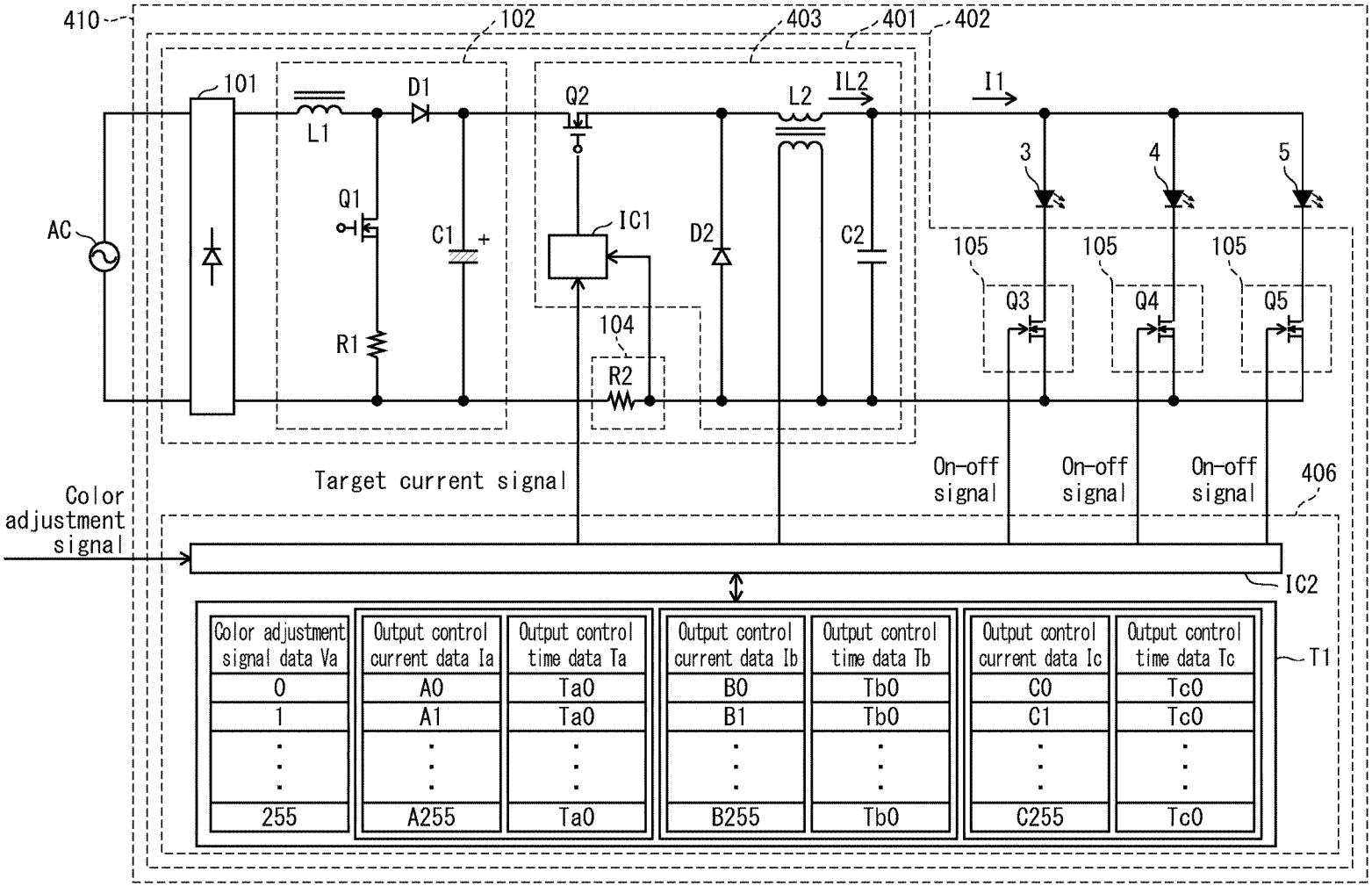
FIG. 9 is a circuit diagram of an illumination apparatus relating to an embodiment of the present embodiment.
Figure 10:
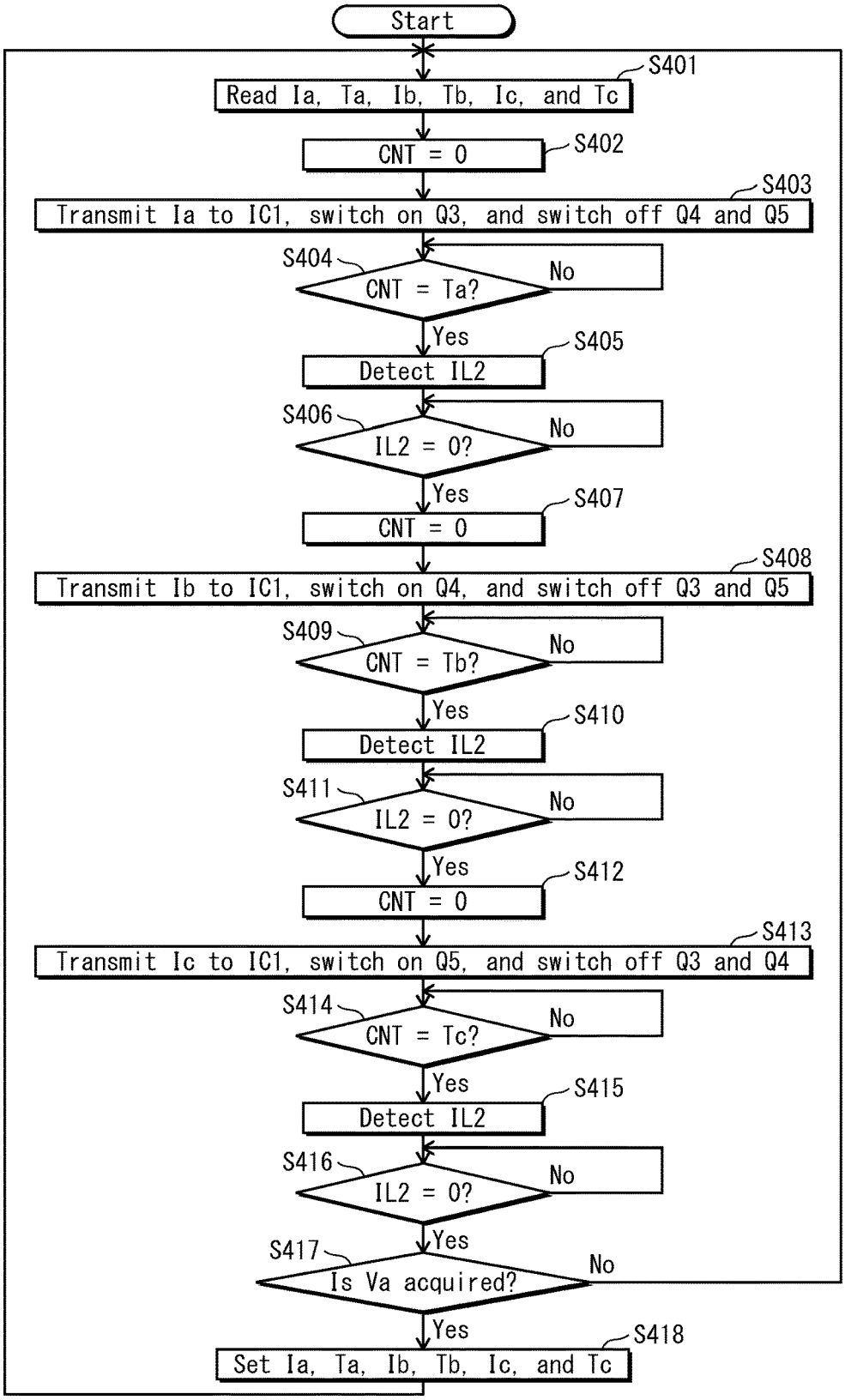
FIG. 10 is a flowchart of operation of a control circuit illustrated in FIG. 9.

FIG. 9 is a circuit diagram illustrating a lighting device relating to a fourth embodiment of the present invention and FIG. 10 is a flowchart illustrating operation of a control circuit relating to the fourth embodiment. The fourth embodiment differs from the first embodiment in terms that timing at which each of the switching elements Q3, Q4, and Q5 is switched on matches timing at which pulsating current IL2 flowing through inductor L2 is equal to zero. Note that a chromaticity table in the fourth embodiment is the same as the chromaticity table in the first embodiment. The following explanation focuses on differences between the fourth embodiment and the first embodiment. Elements of configuration which are the same as in the first embodiment are labeled using the same reference signs and explanation thereof is omitted.

As illustrated in FIG. 9, a control circuit 406 includes a secondary coil which is magnetically coupled to the inductor L2 in a DC voltage conversion circuit 403. The control circuit 406 detects pulsating current IL2 flowing through the inductor L2 of the DC voltage conversion circuit 403 by detecting a voltage induced in the secondary coil. At a time at which pulsating current IL2 flowing through the inductor becomes equal to zero, the control circuit 406 switches on one of the switching elements Q3, Q4, and Q5 in accordance with a preset order. The following explains processing performed by the control circuit 406 with reference to FIG. 10.

First, upon the control circuit 406 being started-up by switching on a power source, the control circuit 406 reads values of output control current data Ia, Ib, and Ic, and output control time data Ta, Tb, and Tc from the memory (Step S401), and resets the timer (Step S402). Next, the control circuit 406 outputs a target current signal indicating the output control current data Ia to the micro-computer IC1, switches on the switching element Q3, and switches off the switching elements Q4 and Q5 (Step S403). Through the above, among the LEDs 3, 4, and 5, current Ia only flows in the LED 3 and only the LED 3 emits light of a luminance in accordance with magnitude of the current Ia. When time indicated by the timer matches the output control time data Ta (Step S404: Yes), the control circuit 406 detects pulsating current IL2 flowing through the inductor L2 (Step S405). Once pulsating current IL2 is equal to zero (Step S406: Yes), the control circuit 406 resets the timer (Step S407). The control circuit 406 outputs a target current signal indicating the output control current data Ib to the micro-computer IC1, switches on the switching element Q4, and switches off the switching elements Q3 and Q5 (Step S408). Through the above, among the switching elements Q3, Q4, and Q5, the switching element that is switched on is changed from the switching element Q3 to the switching element Q4. As a result, among the LEDs 3, 4, and 5, current Ib only flows through the LED 4 and only the LED 4 emits light of a luminance in accordance with magnitude of current Ib.

Once time indicated by the timer matches the output control time data Tb (Step S409: Yes), the control circuit 406 detects pulsating current IL2 flowing through the inductor L2 (Step S410). Once pulsating current IL2 is equal to zero (Step S411: Yes), the control circuit 406 resets the timer (Step S412). The control circuit 406 outputs a target current signal indicating the output control current data Ic to the micro-computer IC1, switches on the switching element Q5, and switches off the switching elements Q3 and Q4 (Step S413). Through the above, among the switching elements Q3, Q4, and Q5, the switching element that is switched on is changed from the switching element Q4 to the switching element Q5. As a result, among the LEDs 3, 4, and 5, current Ic only flows through the LED 5 and only the LED 5 emits light of a luminance in accordance with magnitude of current Ic.

Once time indicated by the timer matches the output control time data Tc (Step S414: Yes), the control circuit 406 detects pulsating current IL2 flowing through the inductor L2 (Step S416). Once pulsating current IL2 is equal to zero (Step S417: Yes), if not acquiring color adjustment signal data Va from the outside (Step S418: No), the control circuit 406 reads out the output control current data Ia, Ib, and Ic, and the output control time data Ta, Tb, and Tc from the memory (Step S401). The control unit 406 repeats Steps S402 to S418. On the other hand, if acquiring color adjustment signal data Va from the outside (Step S418: Yes), the control circuit 406 selects the output control current data Ia, Ib, and Ic, and the output control time data Ta, Tb, and Tc from the chromaticity table T1 in accordance with the color adjustment signal data Va, and memorizes the output control current data Ia, Ib, and Ic, and the output control time data Ta, Tb, and Tc, which are selected above, in the memory (Step S418). The control circuit 406 subsequently reads out the output control current data Ia, Ib, and Ic, and the output control time data Ta, Tb, and Tc from the memory (Step S401). The control unit 406 repeats Steps S402 to S418.

Figure 11:
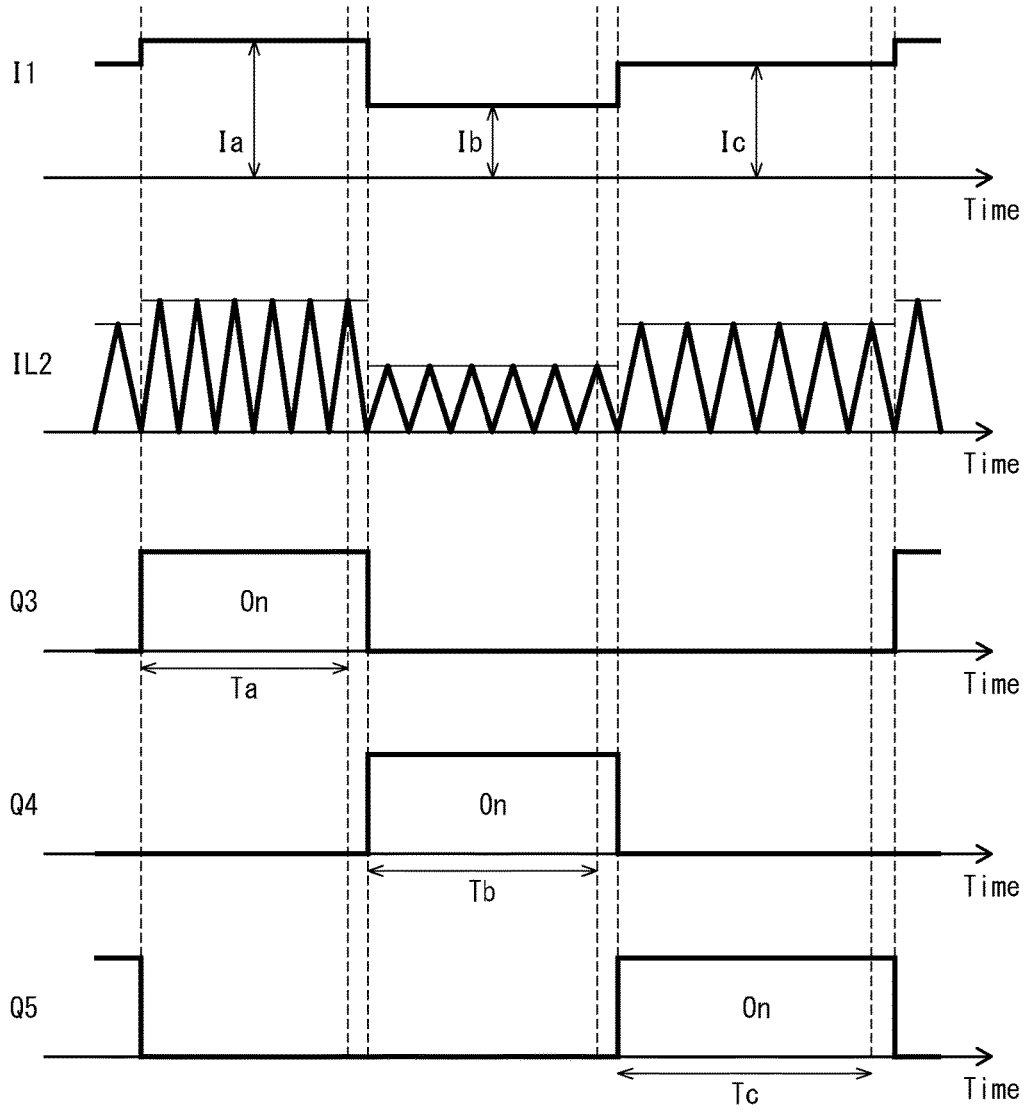
FIG. 11 is a waveform diagram of DC output from a DC power supply circuit, current output from an inductor L2, and voltage output to respective gates of switching elements Q3, Q4, and Q5 in the illumination apparatus illustrated in FIG. 9.

As illustrated by the waveform diagram in FIG. 11, after on-period Ta elapses from the switching element Q3 being switched on, pulsating current IL2 flowing through the inductor L2 is approximately equal to zero. At this time, the switching element Q3 is switched off and simultaneously the switching element Q4 is switched on, thereby causing current to start flowing through the LED 4. In the same way, after on-period Tb elapses from the switching element Q4 being switched on, pulsating current IL2 flowing through the inductor L2 is approximately equal to zero. At this time, the switching element Q4 is switched off and simultaneously the switching element Q5 is switched on, thereby causing current to start flowing through the LED 5. In the same way, after on-period Tc elapses from the switching element Q5 being switched on, pulsating current IL2 flowing through the inductor L2 is approximately equal to zero. At this time, the switching element Q5 is switched off and simultaneously the switching element Q3 is switched on, thereby causing current to start flowing through the LED 3.

After the on-period Ta elapses from current Ia starting to flow in the LED 3, the switching element Q3 is switched off and the switching element Q4 is switched on, thereby causing current Ib to flow through the LED 4. Note that a time at which the on-period Ta is completed does not necessarily coincide with a time at which pulsating current IL2 flowing through the inductor L2 is approximately equal to zero. Consequently, in a situation in which current Ia is greater than current Ib, depending on the end of the on-period Ta, pulsating current IL2 flowing through the inductor L2 may be greater than current Ib. In such a situation, if the switching element Q4 is switched on at the end of the on-period Ta, pulsating current IL2 that is greater than current Ib will momentarily flow through the LED 4, causing brightness of the LED 4 to deviate from target brightness thereof. As a result of the above, chromaticity of mixed light emitted from the LEDs 3, 4, and 5 deviates from desired chromaticity. In the illumination apparatus 410, respective times at which the switching elements Q3, Q4, and Q5 are switched on are each adjusted to coincide with a time at which pulsating current IL2 flowing through the inductor L2 is equal to zero. The above ensures that currents Ia, Ib, and Ic correctly flow through the LEDs 3, 4, and 5 respectively. Therefore, the above configuration enables mixed light of a desired chromaticity to be obtained.

Fifth Embodiment

Figure 12:
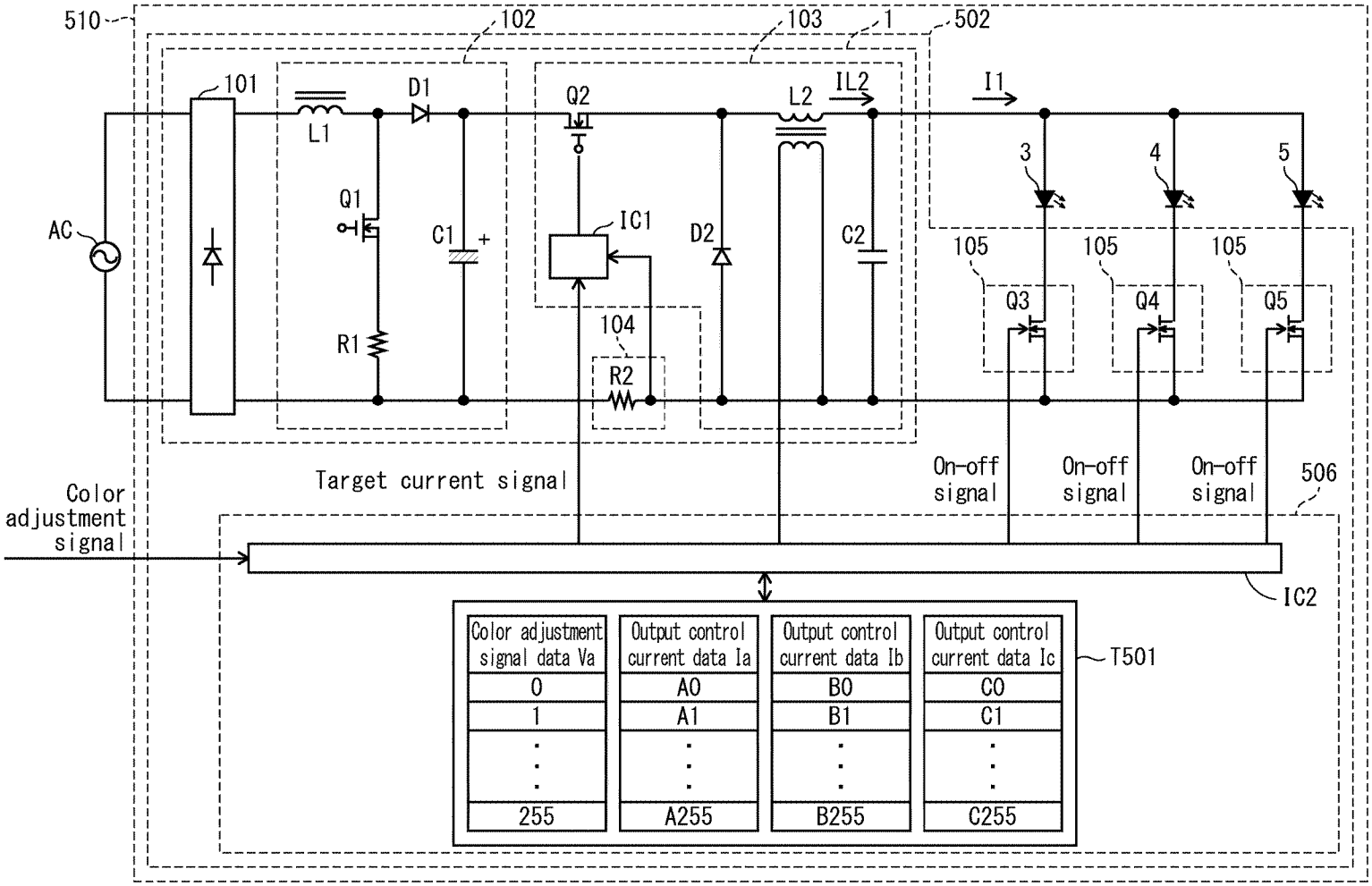
FIG. 12 is a circuit diagram of an illumination apparatus relating to an embodiment of the present invention.
Figure 13:
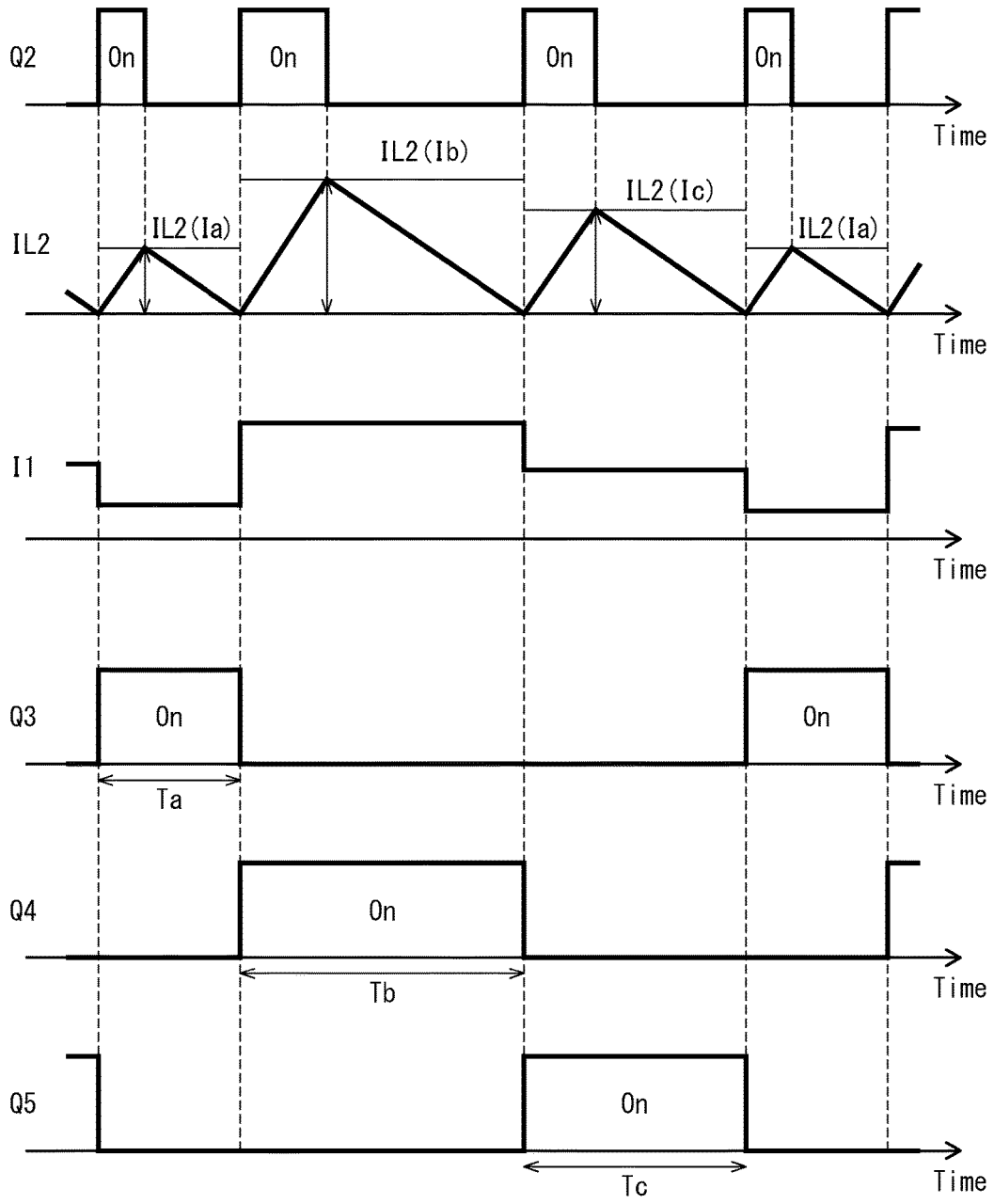
FIG. 13 is a waveform diagram of voltage output to a gate of a switching element Q2, current output from an inductor L2, DC output from a DC power supply circuit, and voltage output to respective gates of switching elements Q3, Q4, and Q5 in the illumination apparatus illustrated in FIG. 12.

FIG. 12 is a circuit diagram illustrating a lighting device relating to a fifth embodiment of the present invention and FIG. 13 is a waveform diagram for the lighting device relating to the fifth embodiment. The fifth embodiment differs from the fourth embodiment in terms that output control time data Ta, Tb, and Tc are not necessary, and on-off switching operation of switching elements Q3, Q4, and Q5 is performed when pulsating current flowing through inductor L2 is approximately equal to zero during an off-period of switching element Q2 after the switching element Q2 is switched on. The following explanation focuses on differences between the fifth embodiment and the fourth embodiment. Elements of configuration which are the same as in the fourth embodiment are labeled using the same reference signs and explanation thereof is omitted.

As illustrated in FIG. 12, a control circuit 506 includes a chromaticity table T501 in which only output control current data Ia, Ib, and Ic indicating target current magnitudes are preset. In the chromaticity table T501, the output control current data Ia has 256 different values ranging from A0 to A255. The same also applies to the output control current data Ib and Ic. In other words, in the chromaticity table T501, the color adjustment signal data Va is linked to the output control current data Ia, Ib, and Ic, which respectively correspond to current magnitudes for the LEDs 3, 4, and 5. Therefore, in the chromaticity table T501, the output control current data Ia, Ib, and Ic are changed in value for every color adjustment signal data Va.

As a result of control by the control circuit 506, when pulsating current IL2 flowing through the inductor L2 becomes approximately equal to zero during an off-period of the switching element Q2 after the switching element Q2 is switched on, the switching element Q3 is switched off and simultaneously the switching element Q4 is switched on. In the same way, when pulsating current IL2 flowing through the inductor L2 becomes approximately equal to zero during the next (second) off-period of the switching element Q2, the switching element Q4 is switched off and simultaneously the switching element Q5 is switched on. In the same way, when pulsating current IL2 flowing through the inductor L2 becomes approximately equal to zero during the third off-period of the switching element Q2, the switching element Q5 is switched off and simultaneously the switching element Q3 is switched on.

A lighting device 502 enables color adjustment of mixed light emitted from the LEDs 3, 4, and 5 by changing the output control current data Ia, Ib, and Ic included in the chromaticity table T501.

The switching element Q2 is typically operated at high frequency. In the lighting device 502, operation of the switching element Q2 has the same periodicity as operation of the switching elements Q3, Q4, and Q5. As a result, the LEDs 3, 4, and 5 are changed alternately at high frequency to be lit. Therefore, light flickers of the mixed light, which occur in alternately changing the switching elements Q3, Q4, and Q5 to be switched on, are inhibited to a greater degree. The configuration described above also enables reduction in amount of data included in the chromaticity table T501, thereby enabling reduction in storage capacity of the micro-computer IC2.

Sixth Embodiment

Figure 14:
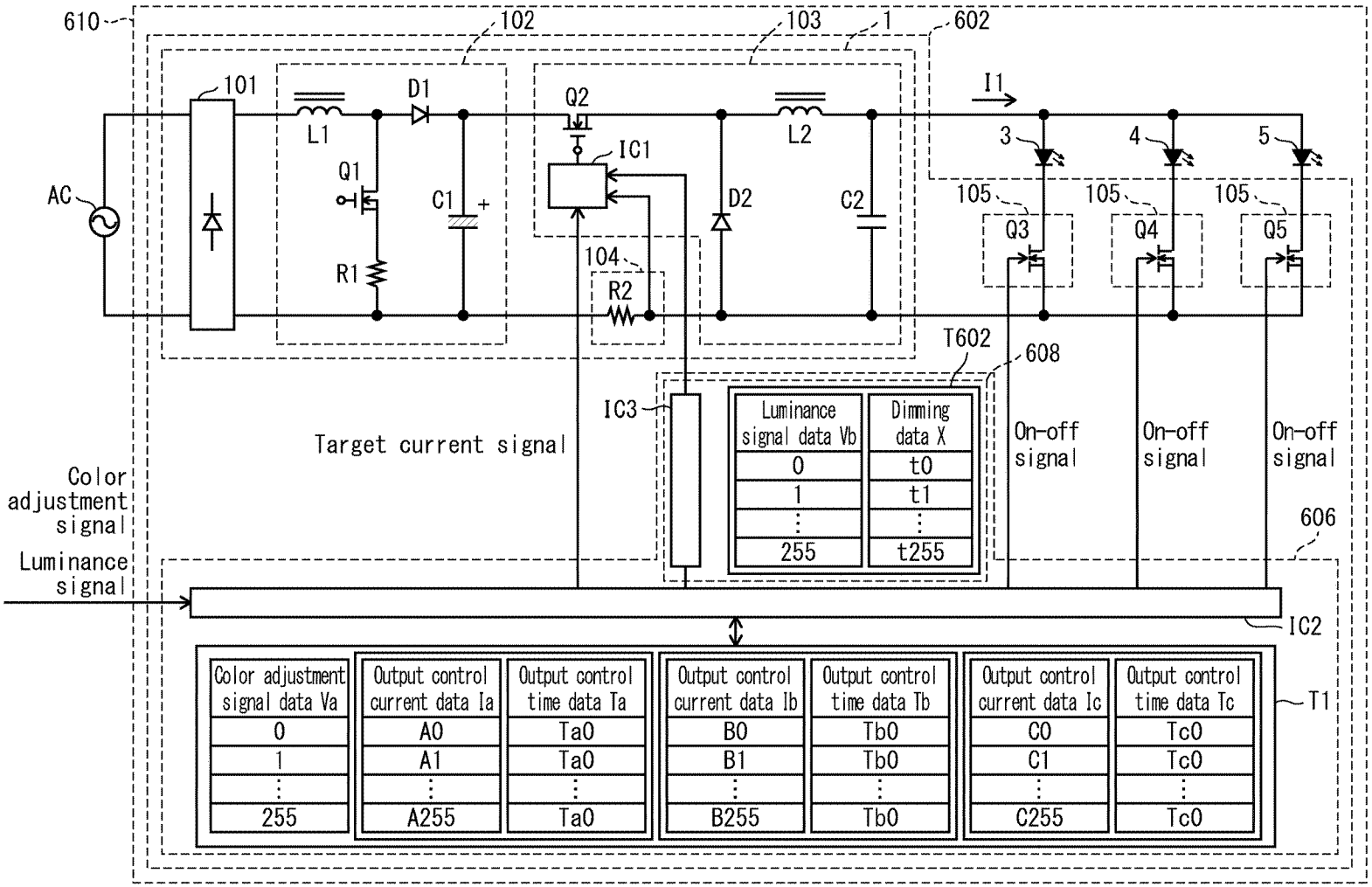
FIG. 14 is a circuit diagram of an illumination apparatus relating to an embodiment of the present invention.
Figure 15:
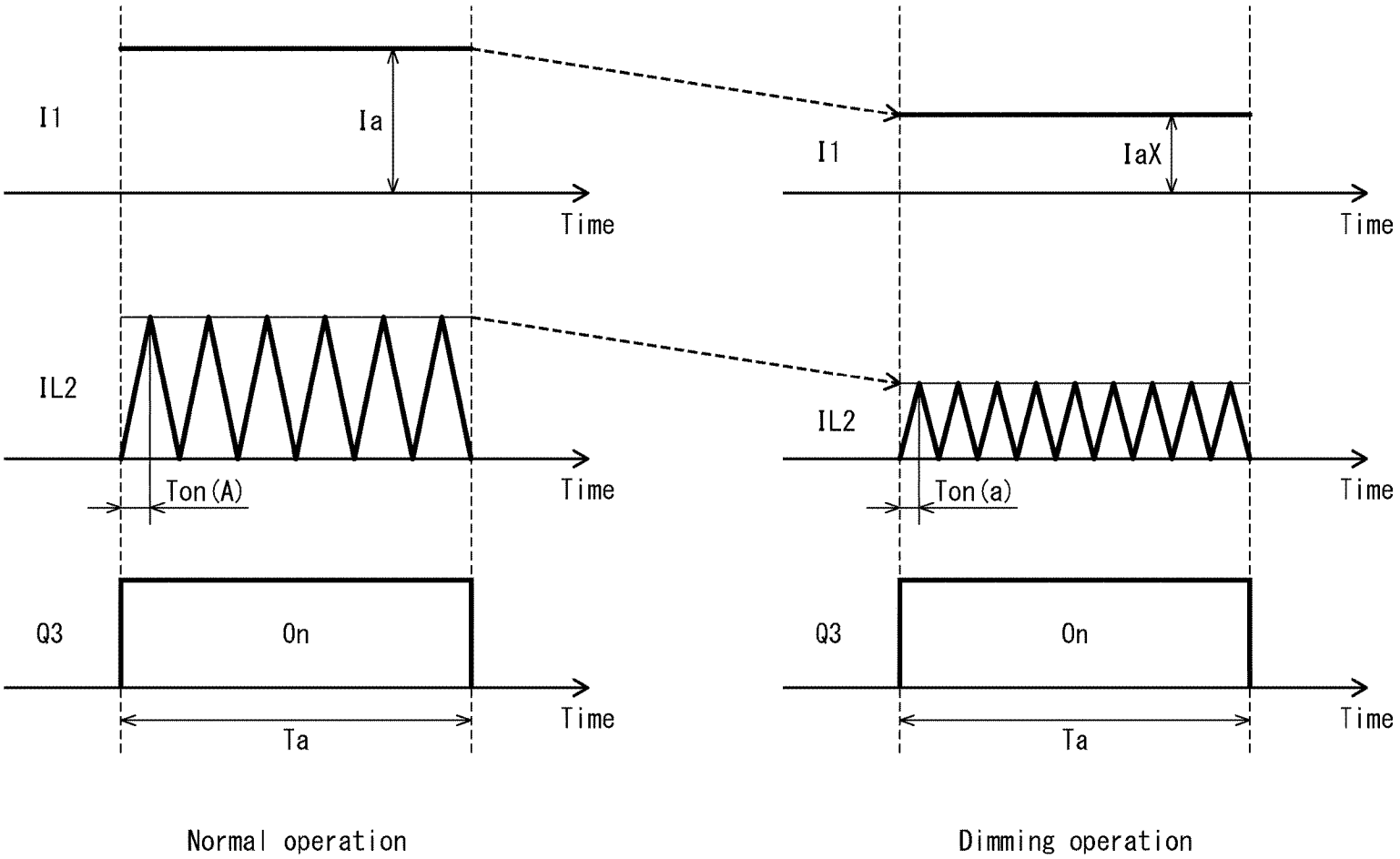
FIG. 15 is a waveform diagram of DC output from a DC power supply circuit, current output from an inductor L2, and voltage output to a gate of a switching element Q3 in the illumination apparatus illustrated in FIG. 14 during normal operation (left-hand side) and during dimming operation (right-hand side)

FIG. 14 is a circuit diagram illustrating a lighting device relating to a sixth embodiment of the present invention and FIG. 15 is a waveform diagram for the lighting device relating to the sixth embodiment. The sixth embodiment differs from the first embodiment in terms that target current magnitudes are adjusted in accordance with an externally inputted signal indicating target luminance of mixed light, thereby performing luminance adjustment (i.e., dimming) of the mixed light by adjusting brightness of light-emission of each of the LEDs 3, 4, and 5, with chromaticity of the mixed light fixed. The following explanation focuses on differences between the sixth embodiment and the first embodiment. Elements of configuration which are the same as in the first embodiment are labeled using the same reference signs and explanation thereof is omitted.

As illustrated in FIG. 14, in addition to a color adjustment signal, a luminance signal is also inputted to control circuit 606 from the outside. The luminance signal indicates target luminance for the mixed light emitted from the LEDs 3, 4, and 5. The color adjustment signal and the luminance signal are transmitted as a digital multiplex (DMX) signal. The micro-computer IC2 outputs a voltage signal indicating the luminance signal to a micro-computer IC3. A PWM dimming control circuit 608 is located between the micro-computer IC1 and the micro-computer IC2. The PWM dimming control circuit 608 includes the micro-computer IC3 and a luminance table T602. The micro-computer IC3, in accordance with luminance signal data Vb, outputs a voltage signal indicating dimming data X to the pulse oscillator circuit of the micro-computer IC1 with reference to the luminance table T602. During the above operation, the micro-computer IC3 functions as a luminance reading unit. The dimming data X is set in advance in the luminance table T602. In the luminance table T602, the luminance signal data Vb has 256 different values ranging from 0 to 255. The dimming data X has 256 different values ranging from t0 to t255 in the luminance table T602. The dimming data X satisfy a relationship $0<X\leq 1$. Current Ia·X, which is obtained by multiplying the output control current data Ia and the dimming data X, is therefore smaller than Ia. Thus, PWM control of the switching element Q2 is performed in accordance with the output control current data Ia·X, thereby decreasing brightness of the LED 3. The same also applies to the output control current data Ib and Ic, and the LEDs 4 and 5. Thus, in the luminance table T602, each of the luminance signal data Vb, indicating a target luminance that can be notified through use of a luminance signal, is linked to the dimming data X, indicating a multiplication factor. When the luminance signal data Vb has a value of 0, the micro-computer IC3 selects dimming data X having a value of to. Likewise, when the luminance signal data Vb has a value other than 0, a value of the dimming data X linked to the above luminance signal data Vb in the luminance table T602 is selected.

The following explains operation of the lighting device 602. FIG. 15 illustrates output current I1 from the DC voltage conversion circuit, pulsating current IL2 through the inductor L2, and operational state of the switching element Q3 during normal operation (left-hand side). FIG. 15 also illustrates output current I1 from the DC voltage conversion circuit, pulsating current IL2 through the inductor L2, and operational state of the switching element Q3 during dimming operation (right-hand side).

During normal operation, the micro-computer IC3 outputs dimming data X having a value of 1 to the micro-computer IC1. Next, the micro-computer IC1 performs PWM control of the switching element Q2 to adjust output current from the DC voltage conversion circuit 103 so as to have a current value of Ia·1, i.e., the output control current data Ia outputted from the micro-computer IC2 to the micro-computer IC1 is multiplied by a factor of 1. In other words, the micro-computer IC1 performs PWM control of the switching element Q2 such that output current from the DC voltage conversion circuit 103 matches a current value of Ia. During normal operation, the switching element Q2 has an on-period length Ton (A).

On the other hand, during dimming operation, the micro-computer IC3 outputs dimming data X as a value satisfying 0<X<1 to the micro-computer IC1. Next, the micro-computer IC1 performs PWM control of the switching element Q2 to adjust output current from the DC voltage conversion circuit 103 so as to have a current value of Ia·X, i.e., the output control current data Ia outputted from the micro-computer IC2 to the micro-computer IC1 is multiplied by a factor of X. In other words, the micro-computer IC1 performs PWM control of the switching element Q2 such that output current from the DC voltage conversion circuit 103 matches a current value of Ia·X. During dimming operation, the switching element Q2 has an on-period length Ton (a), which is shorter than the on-period length Ton (A) of the switching element Q2 during normal operation. The same operation is performed for the LEDs 4 and 5. As a consequence, the output current from the DC voltage conversion circuit 103 can be reduced at the same ratio for all of the LEDs 3, 4, and 5 in accordance with the luminance signal which is inputted from the outside. The lighting device 602 therefore enables dimming of mixed light emitted from the LEDs 3, 4, and 5 while fixing the mixed light at a constant color.

Note that, in the case where the apparatus is implemented by a single line system, externally inputted signals, not limited to a DMX signal, may be a digital addressable lighting interface (DALI) signal, a universal asynchronous receiver transmitter (UART) signal, or the like. Further alternatively, the color adjustment signal and the luminance signal may be input separately through a two line system.

Note that a configuration in which target current is changed to adjust a sum of the product of luminance and light-emission time is not limited to the configuration of the sixth embodiment. For example, the micro-computer IC2 may detect dimming data X from a luminance signal transmitted as a pulse signal, and PWM control of the switching element Q2 may be performed using, as target current magnitudes, currents Ia·X, Ib·X, and Ic·X that are respectively obtained by multiplying output values of control current data Ia, Ib, and Ic by a factor of X.

Seventh Embodiment

Figure 16:
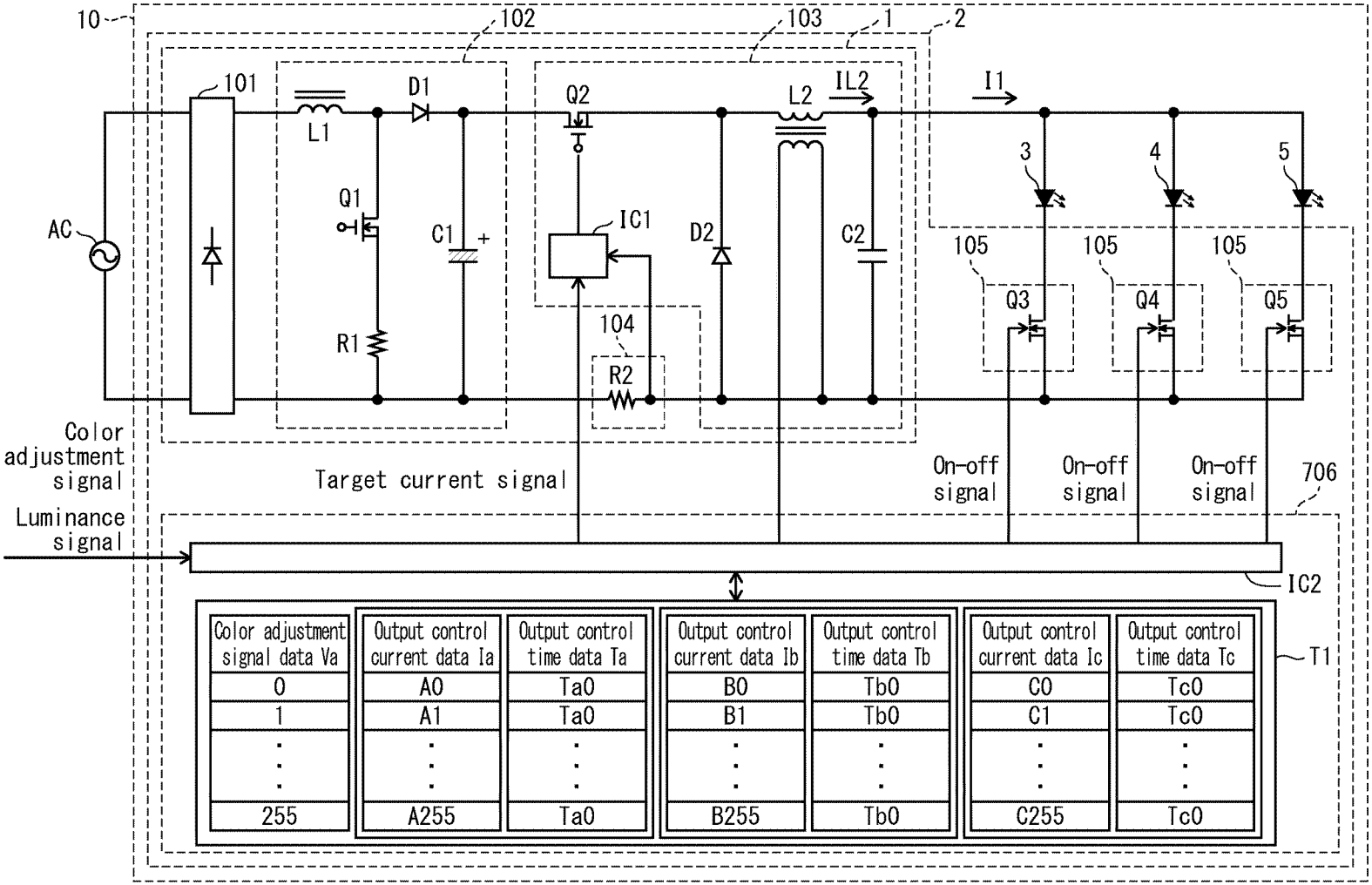
FIG. 16 is a circuit diagram of an illumination apparatus relating to an embodiment of the present invention.
Figure 17:
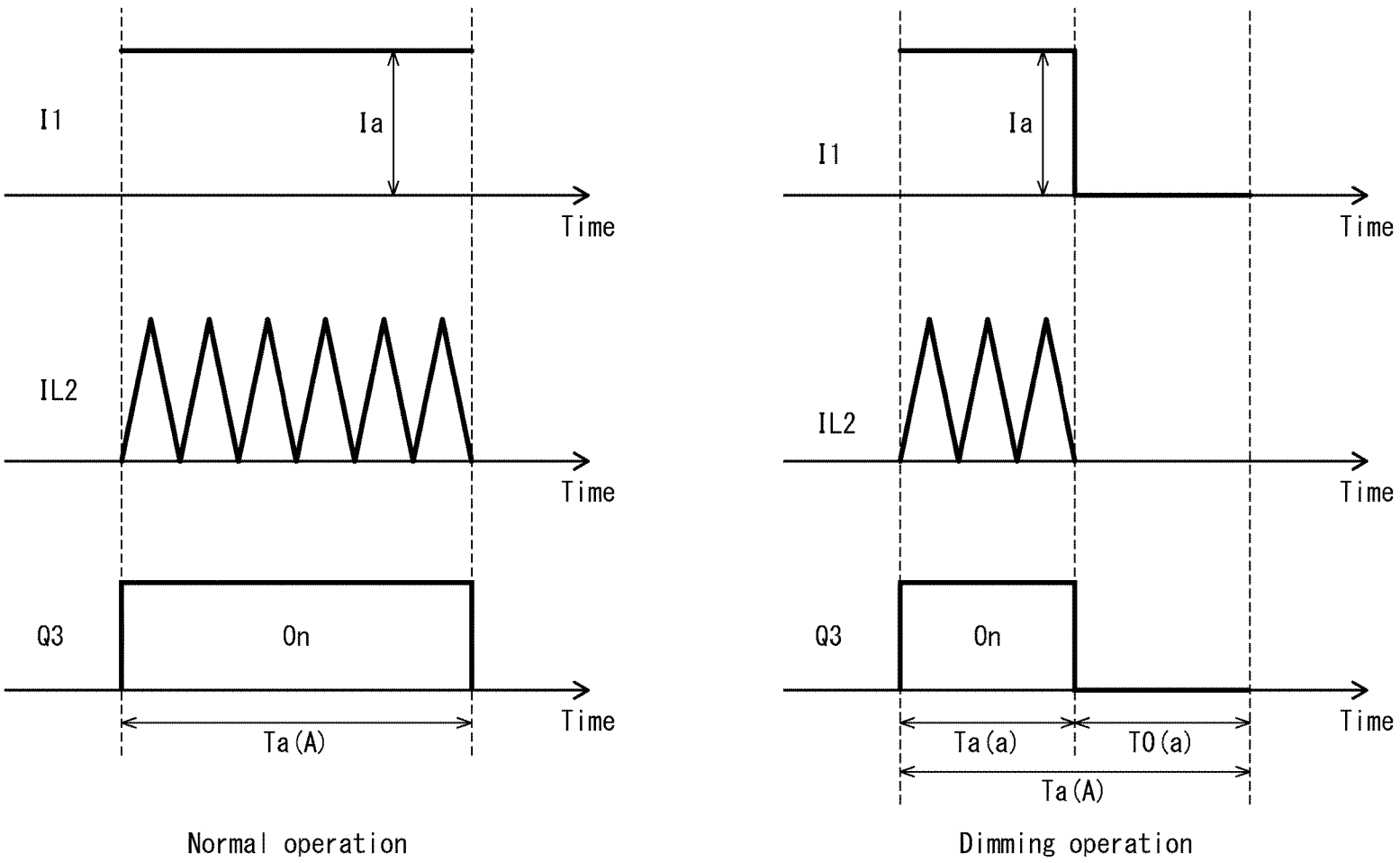
FIG. 17 is a waveform diagram of DC output from a DC power supply circuit, current output from an inductor L2, and voltage output to a gate of a switching element Q3 in the illumination apparatus illustrated in FIG. 16 during normal operation (left-hand side) and during dimming operation (right-hand side)
Figure 18:
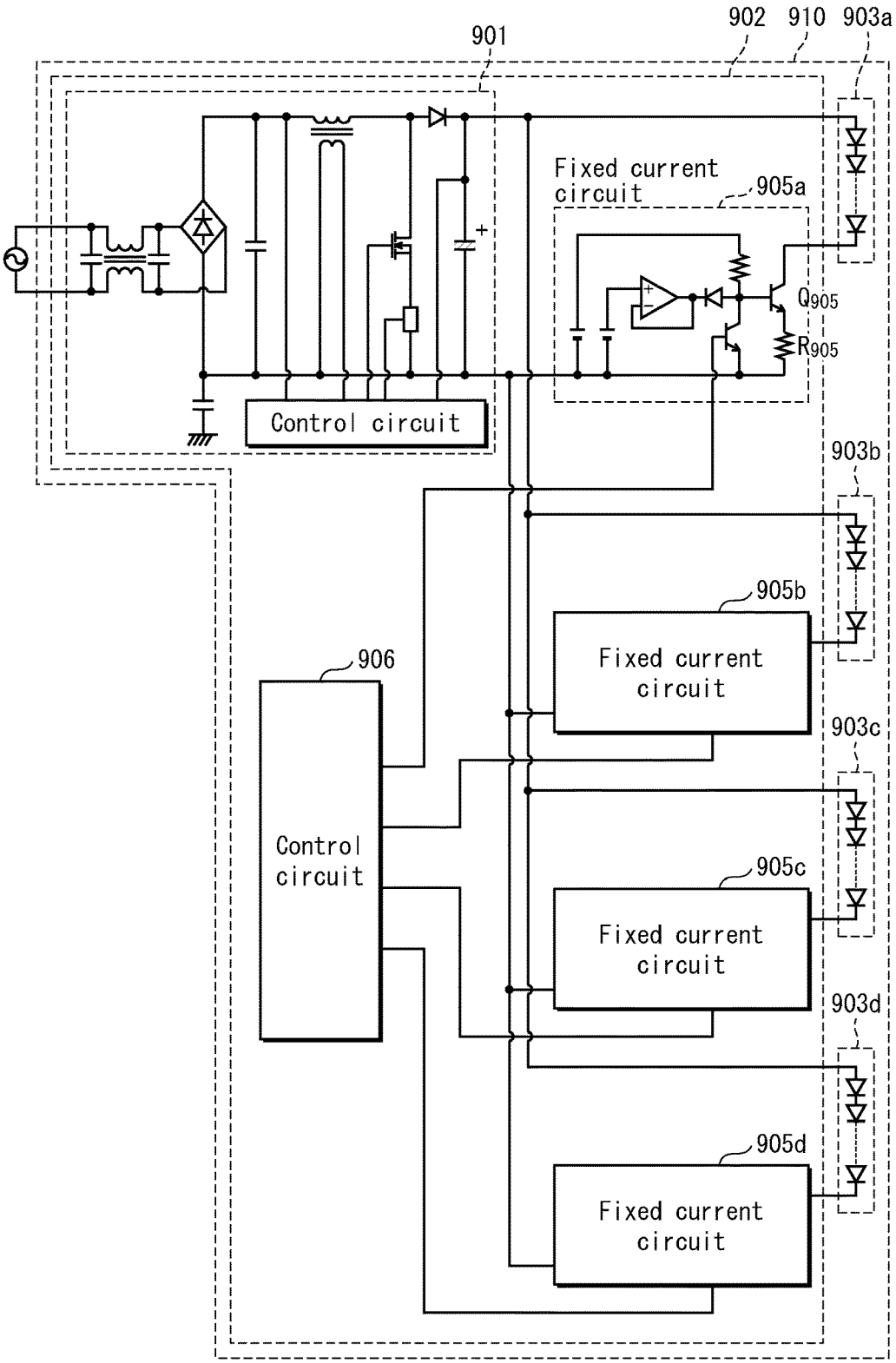
FIG. 18 Prior Art
FIG. 18 is a block diagram of a conventional illumination apparatus.

FIG. 16 is a circuit diagram illustrating a lighting device relating to a seventh embodiment of the present invention and FIG. 17 is a waveform diagram for the lighting device relating to the seventh embodiment. The seventh embodiment differs from the sixth embodiment in that mixed light of the LEDs 3, 4, and 5 is dimmed not by controlling the switching element Q2 but by adjusting on-period lengths of the switching elements Q3, Q4, and Q5 for controlling current flowing through the LEDs 3, 4, and 5. The following explanation focuses on differences between the seventh embodiment and the sixth embodiment. Elements of configuration which are the same as in the sixth embodiment are labeled using the same reference signs and explanation thereof is omitted.

As illustrated in FIG. 16, in addition to a color adjustment signal, a luminance signal is also inputted to control circuit 706 from the outside. The luminance signal indicates target luminance for mixed light emitted from the LEDs 3, 4, and 5. The luminance signal is transmitted as a PWM signal. The micro-computer IC2 detects a duty cycle of the luminance signal which has been inputted and uses the duty cycle as dimming data X'. The dimming data X' has a value satisfying a relationship 0<X'≤1. Respective target on-period lengths for the switching elements Q3, Q4, and Q5 are adjusted through the dimming data X'.

On-off control of the switching elements Q3, Q4, and Q5 is performed as explained below. First, the micro-computer IC2 resets the timer. The micro-computer IC2 also transmits an on-signal to the switching element Q3 and transmits off-signals to the switching elements Q4 and Q5 during on-period Ta (a) obtained by multiplying Ta0 by X'. Until the timer indicates the time Ta (A) after on-period Ta (a) elapses, the micro-computer IC2 transmits off-signals to all of the switching elements Q3, Q4, and Q5. Next, the micro-computer IC2 resets the timer. The micro-computer IC2 also transmits an on-signal to the switching element Q4 and transmits off-signals to the switching elements Q3 and Q5 during on-period Tb (b) obtained by multiplying Tb0 by X'. Until the timer indicates the time Tb (B) after on-period Tb (b) elapses, the micro-computer IC2 transmits off-signals to all of the switching elements Q3, Q4, and Q5. Further, the micro-computer IC2 resets the timer. The micro-computer IC2 also transmits an on-signal to the switching element Q5 and transmits off-signals to the switching elements Q3 and Q4 during on-period Tc (c) obtained by multiplying Tc0 by X'. Until the timer indicates the time Tc (C) after on-period Tc (c) elapses, the micro-computer IC2 transmits off-signals to all of the switching elements Q3, Q4, and Q5. During the above operation, the micro-computer IC2 functions as a luminance control unit. Current flows through the LED 3 during period Ta (a) obtained by multiplying output control time data Ta by X'. However, current is not allowed to flow through the LED 3 during period T0 (a) obtained by multiplying the output control time data Ta by 1−X', thereby reducing brightness of the LED. The same also applies to the output control time data Tb and Tc, and the LEDs 4 and 5. As described above, on-period length of the switching element Q3 is adjusted to match the value obtained by multiplying the output control time data Ta by X'. Likewise, on-period lengths of switching elements Q4 and Q5 are adjusted to match values obtained by multiplying the output control time data Tb by X' and obtained by multiplying the output control time data Tc by X'.

The following explains dimming operation of lighting device 702. FIG. 17 illustrates output current I1 from the DC voltage conversion circuit 103, pulsating current IL2 through the inductor L2, and on-off state of the switching element Q3 during normal operation (left-hand side). FIG. 17 also illustrates output current I1 from the DC voltage conversion circuit 103, pulsating current IL2 through the inductor L2, and on-off state of the switching element Q3 during dimming operation (right-hand side).

During normal operation, a luminance signal is inputted to the micro-computer IC2 from the outside to adjust dimming data X' to 1. The value Ta obtained by multiplying the control time data Ta by a factor of 1 serves as on-period length Ta (A) of the switching element Q3.

On the other hand, during dimming operation, a luminance signal is inputted to the micro-computer IC2 from the outside to adjust dimming data X' to 0<X'<1. In such a situation, the value Ta (a) obtained by multiplying the output control time data Ta, which is outputted from the micro-computer IC2 to the micro-computer IC1, by X' serves as the on-period length of the switching element Q3. On-period length Ta (a) of the switching element Q3 during dimming operation is shorter than on-period length Ta (A) of the switching element Q3 during normal operation. Note that during a period T0 (a) obtained by multiplying the output control time data Ta by 1−X', all of the switching elements Q3, Q4, Q5 are in a switched-off state. During dimming operation, to fix a ratio of the LEDs 3, 4, and 5 in terms of a product of luminance and light-emission time, the above operation is also performed with respect to the LEDs 4 and 5. As a result of the above, respective on-period lengths of the switching elements Q3, Q4, and Q5 are reduced at the same ratio in accordance with the luminance signal from the outside. The lighting device 702 therefore enables dimming of mixed light emitted from the LEDs 3, 4, and 5, while fixing the mixed light at a constant color.

The lighting device 702 also enables dimming of the mixed light without changing operation of the switching element Q2 between dimming operation and normal operation. Therefore, the lighting device 702 enables implementation of a wide range of dimming control without needing to take into account a maximum operating frequency of the switching element Q2.

Note that a configuration in which target on-period lengths for switching elements are changed to adjust a sum of the product of luminance and light-emission time is not limited to the configuration of the seventh embodiment. For example, the table of the control circuit 706 may include dimming data X' linked to a luminance signal, and by using the dimming data X', target on-period lengths for the switching elements may be changed.

As described above, to perform dimming of mixed light while fixing the mixed light at a constant chromaticity, it is necessary to fix a ratio of the light sources in terms of the product of target current, to be flowed through each light source, and target on-period length of a switching element and to adjust a sum of the aforementioned product. In other words, it is necessary to fix a ratio of the light sources in terms of the product of luminance and light-emission time thereof, and to adjust a sum of the aforementioned product.

Modified Examples

The above explains embodiments of the present invention, but the present invention is of course not limited to the embodiments described above. For example, various modified examples such as explained below are also possible.

1. Light Sources

In the embodiments described above, each of the light sources is implemented as an LED, but the light sources are not limited to LEDs. For example, alternatively each of the light sources may be an organic electroluminescence (EL) element, a laser diode (LD), or any other type of lamp.

In the embodiments described above, LEDs with three different types of light-emission color are used, but the number of different types of light-emission color is not limited to three. For example, alternatively two different types of light-emission color or four different types of light-emission color may be used. In particular, when LEDs with three or more different types of light-emission color are used, chromaticity of mixed light emitted from the LEDs can be adjusted along a curved line in a chromaticity diagram. Adjustment of chromaticity along a curved line in a chromaticity diagram allows application in manufactured products that adjust chromaticity between incandescent and neutral white in accordance with a blackbody locus and CIE daylight.

Also, in the embodiments described above, all of the light sources differ from one another in terms of light-emission color. However, the present invention is applicable even when at least one LED has a different light-emission color from the other LEDs and thereby the one LED has a different voltage drop when the same current flows in the LEDs.

In the embodiments described above, light-emission colors of the LEDs are R, G, and B. However, the above is not a limitation. For example, to obtain light-emission colors of R, G, and W (white), LEDs emitting primary color light and LEDs emitting white light may be mixed. Further alternatively, the LEDs may emit white light of different color temperatures from one another.

2. DC Power Supply Circuit

In the embodiments described above, the smoothing circuit is implemented as a step-up chopper circuit, but alternatively the smoothing circuit may, for example, be implemented simply as a smoothing capacitor. Also, in the embodiments described above, the DC voltage conversion circuit is implemented as a step-down chopper circuit, but alternatively the DC voltage conversion circuit may be implemented as a different type of DC-DC converter, such as a fly-back circuit.

3. Light Source Switches

In the embodiments described above, the light source switches are each implemented as a MOSFET, but alternatively the light source switches may be implemented as a different type of switching element, such as a bipolar transistor.

4. Control Circuit

In the embodiments described above, chromaticity of mixed light emitted from the LEDs 3, 4, and 5 is preset using a table, but the above is not a limitation. For example, brightness of the LEDs 3, 4, and 5 may be individually adjustable. In such a situation, a color adjustment signal inputted to the control circuit includes information indicating brightness individually for each of the LEDs 3, 4, and 5. Thus, the control circuit individually controls brightness of the LEDs 3, 4, and 5 in accordance with the aforementioned information. The above configuration enables omission of a table for presetting chromaticity from the control unit, and thereby enables reduction in micro-computer storage capacity.

Also, in the embodiments described above, chromaticity of mixed light emitted from the LEDs 3, 4, and 5 is adjusted, but the above is not a limitation. For example, alternatively chromaticity of the mixed light emitted from the LEDs 3, 4, and 5 may be fixed.

5. Lighting Device Application Examples

A lighting device relating to one aspect of the present invention may be applied to various different types of illumination apparatus. For example, the lighting device may be applied to a down light, a spot light, or a ceiling light. Furthermore, it is possible to provide an illumination apparatus that is easily controllable by including the aforementioned lighting device therein.

6. Supplementary Explanation

The lighting device relating to one aspect of the present invention may further cause the control circuit to perform specific operations for component or circuit abnormality in the DC power supply circuit. For example, assuming that a chopping switch in the DC power supply circuit is abnormally heated, the control circuit may include a sensor for detecting heat discharge. In such a configuration, the control circuit disconnects all of the light sources from the DC power supply circuit upon detecting abnormal heat discharge by using the chopping switch in the DC power supply circuit. The above inhibits breakdown of the light sources, which may otherwise occur due to output of excessive large current thereto.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

The invention claimed is:

1. An illumination apparatus comprising:

a plurality of light sources with different light-emission colors from one another, each having a different voltage drop value when an identical current flows therein;

a DC power supply circuit having a pair of output terminals for outputting a DC voltage;

a plurality of light source switches, each being connected in series to a corresponding one of the light sources in one-to-one relationship to form a series circuit that is connected between the pair of output terminals of the DC power supply circuit; and a control circuit configured to control switching of each of the plurality of light source switches, wherein the control circuit performs:

a first control configured to control each of the plurality of light source switches by using a time division control method to alternate each of the plurality of light source switches between a switched-on state and a switched-off state such that on-periods of the plurality of light source switches are not overlapped with one another, each of the on-periods holding each of the plurality of light source switches in the switched-on state; and a second control configured to individually control at least one of a target current magnitude, flowing through each of the plurality of light source switches in the switched-on state, and a target on-period length of each of the plurality of light source switches, and to adjust a ratio of the plurality of light sources in terms of a product of the target current magnitude and the target on-period length, and wherein the control circuit, upon a luminance signal being inputted thereto, fixes the ratio of the plurality of light sources that is adjusted during the second control, and adjusts a sum of the product of the target on-period length and the target current magnitude, and wherein each of the series circuit does not include a resistant element.

2. The illumination apparatus of claim 1, wherein the control circuit includes:

a chromaticity table in which a value indicating a target chromaticity that is notified to the control circuit through a chromaticity adjustment signal is linked to at least one of an on-period length of each of the plurality of light source switches and a current magnitude flowing through each of the plurality of light source switches; and a chromaticity reading unit that, upon the chromaticity adjustment signal being inputted to the control circuit, reads out at least one of an on-period length and a current magnitude corresponding to the chromaticity adjustment signal with reference to the chromaticity table, as the at least one of the target on-period length and the target current magnitude.

3. The illumination apparatus of claim 2, wherein the second control controls the target current magnitude, in the chromaticity table, the value indicating the target chromaticity is linked to a current magnitude flowing through each of the plurality of light sources, the DC power supply circuit is a DC-DC converter including:

a chopping switch for chopping a DC voltage inputted to the DC-DC converter;

a pulse oscillator circuit for alternating the chopping switch between a switched-on state and a switched-off state; and a smoothing circuit for smoothing a pulsating current obtained by chopping the DC voltage, upon the chromaticity adjustment signal being inputted to the control circuit, the chromaticity reading unit reads out the current magnitude linked to the chromaticity adjustment signal from the chromaticity table, and inputs the current magnitude to the pulse oscillator circuit, and the pulse oscillator circuit generates a pulse width modulated pulse to adjust a temporal average of current magnitude flowing in each of the plurality of light sources to the current magnitude inputted from the chromaticity reading unit, and outputs the pulse width modulated pulse to the chopping switch.

4. The illumination apparatus of claim 2, wherein the second control controls the target on-period length of each of the plurality of light source switches, in the chromaticity table, the value indicating the target chromaticity is linked to an on-period length of each of the plurality of light source switches, and upon the chromaticity adjustment signal being inputted to the control circuit, the chromaticity reading unit reads out the on-period length corresponding to the chromaticity adjustment signal from the chromaticity table, and sets the on-period length read from the chromaticity table as a time division length of the time division control performed during the first control.

5. The illumination apparatus of claim 1, wherein the DC power supply circuit is a DC-DC converter including:

a chopping switch for chopping a DC voltage inputted to the DC-DC converter;

a pulse oscillator circuit for alternating the chopping switch between a switched-on state and a switched-off state; and a smoothing circuit for smoothing a pulsating current obtained by chopping the DC voltage, the control circuit includes:

a luminance table in which a value indicating a target luminance that is notified to the control circuit through the luminance signal is linked to a multiplication factor; and a luminance reading unit that, upon the luminance signal being inputted to the control circuit, reads out the multiplication factor linked to the luminance signal with reference to the luminance table, and outputs the multiplication factor to the pulse oscillator circuit, and the pulse oscillator circuit generates a pulse width modulated pulse to adjust a temporal average of current magnitude flowing in each of the plurality of light sources to a current magnitude obtained by multiplying the multiplication factor by the current magnitude adjusted during the second control, and outputs the pulse width modulated pulse to the chopping switch.

6. The illumination apparatus of claim 1, wherein the first control predetermines time division lengths of the time division control performed during the first control, and the control circuit includes a luminance control unit that, upon the luminance signal being inputted to the control circuit, adjusts a ratio of a target on-period length to each of the time division lengths in accordance with the luminance signal.

7. The illumination apparatus of claim 1, wherein the control circuit includes a sensor for detecting abnormity of the DC power supply circuit, and upon the sensor detecting the abnormity of the DC power supply circuit, the control circuit switches off all of the plurality of light source switches.

8. The illumination apparatus of claim 1, wherein the luminance signal and a color adjustment signal are input separately through a two line system.

9. The illumination apparatus of claim 1, wherein the DC power supply circuit is a DC-DC converter including:

a chopping switch for chopping a DC voltage inputted to the DC-DC converter;

a pulse oscillator circuit for alternating the chopping switch between a switched-on state and a switched-off state;

an inductor into which a pulsating current obtained by chopping the DC voltage flows; and a smoothing circuit for smoothing the pulsating current outputted from the inductor, and so as to control luminance, the control circuit configured to keep constant the target on-period length of each of the plurality of light source switches and adjust an on-period length of the chopping switch, or keep constant the on-period length of the chopping switch and adjust the target on-period length of each of the plurality of light source switches.

* * * * *